US005445928A

United States Patent [19]

Schmuck et al.

[11] Patent Number: 5,445,928

[45] Date of Patent: Aug. 29, 1995

[54] COLOR PHOTOGRAPHIC RECORDING MATERIAL

[75] Inventors: Arno Schmuck, Leichlingen; Edgar Draber, Odenthal; Michael Missfeldt, Bergisch Gladbach, all of Germany

[73] Assignee: Agfa-Gevaert AG, Leverkusen, Germany

[21] Appl. No.: 177,992

[22] Filed: Jan. 6, 1994

[30] Foreign Application Priority Data

Jan. 18, 1993 [DE] Germany ..... 43 01 105.5

[51] Int. Cl.[6] ..... G03C 1/08

[52] U.S. Cl. ..... 430/508; 430/504; 430/506; 430/507; 430/509; 430/570; 430/581; 430/582; 430/583; 430/593; 430/595; 430/359

[58] Field of Search ..... 430/508, 570, 507, 359, 430/506, 504, 509, 581, 582, 583, 593, 595

[56] References Cited

U.S. PATENT DOCUMENTS 4,806,460 2/1989 Ogawa et al. ..... 430/504
5,084,374 1/1992 Waki et al. ..... 430/504
5,266,451 11/1993 Schmuck et al. ..... 430/506

FOREIGN PATENT DOCUMENTS 0304297 2/1989 European Pat. Off. .
0409019 1/1991 European Pat. Off. .
0515873 12/1992 European Pat. Off. .

*Primary Examiner*—Charles L. Bowers, Jr.
*Assistant Examiner*—Geraldine Letscher
*Attorney, Agent, or Firm*—Connolly & Hutz

[57] ABSTRACT

A color photographic material comprising at least one cyan-coupling silver halide emulsion layer containing a red sensitizer, at least one magenta-coupling silver halide emulsion layer containing a green sensitizer and at least one yellow-coupling silver halide emulsion layer containing a blue sensitizer on a support, in which a silver halide emulsion is provided in a coupler-free layer sensitized with another spectral sensitizer (a gap sensitizer) of which the sensitization maximum lies between the sensitization maxima of the red- and green-sensitive layers or the green- and blue-sensitive layers, is distinguished by an extended gradation range towards the maximum densities and by distinctly improved detail reproduction in the region of high densities.

19 Claims, No Drawings

COLOR PHOTOGRAPHIC RECORDING MATERIAL

This invention relates to a color photographic recording material comprising a support and having an extended gradation range towards the maximal densities and hence distinctly improved detail reproduction at high densities coupled with excellent color separation.

Poor differentiation in the red tones is a weakness of most commmercially available color negative papers. This weakness appears in particular when films having very high interimage effects and very high color saturation are used and are subsequently copied onto conventional color negative paper.

According to EP 304 297, U.S. Pat. No. 4,806,460 and U.S. Pat. No. 5,084,374, this drawback can be corrected to a certain extent if, in a color photographic material comprising first and second silver halide emulsion layers respectively sensitized to first and second regions of the visible spectrum and each containing dye-producing couplers, the second emulsion layer is also sensitized to a limited extent for the first region of the visible spectrum. If, for example, the red-sensitive layer additionally contains a green sensitizer, 15 as opposed to the original 11 visible stages are now developed in the magenta region. Color photographic materials are normally sensitized for blue light ($\lambda_{max}$ of the sensitizer at 480 nm), green light ($\lambda_{max}$ of the sensitizer at approximately 550 nm) and red light ($\lambda_{max}$ of the sensitizer at approximately 700 nm). This applies in particular to color photographic paper. For reasons of print compatibility (color papers of varying origin must reproduce correct colors with negatives of films of varying origin), there can be no deviation from these absorption ranges.

In the example mentioned, therefore, the red-sensitive layer is also sensitized to a limited extent for the wavelength range around 550 nm (additional green sensitivity) and also for the wavelength range around 480 nm (additional blue sensitivity).

As described above, a secondary density of another color, for example cyan, is produced by this measure, for example in the magenta region (EP 304 297, U.S. Pat. No. 4,806,460) or in the yellow region (U.S. Pat. No. 5,084,374), albeit only in regions of high density. In regions of high red density, the eye perceives this defective color density not as color falsification, but as a deepening of the main color. However, the measure can only be used for red tones without color falsification actually becoming visible. However, the number of gradation stages additionally obtained is still not sufficient. Another disadvantage is that, depending on the additional sensitization, pure magenta and the yellow tones are falsified.

The problem addressed by the present invention was to provide a color photographic material comprising a support which would have an extended gradation range for the color spearations in the region of the maximum densities and hence distinctly improved detail reproduction at high densities and which, in addition, would be distinguished by high color purity, particularly in regard to magenta or yellow.

According to the invention, the solution to this problem is characterized in that, in a color photographic material comprising at least one red-sensitive, cyan-coupling silver halide emulsion layer, at least one green-sensitive magenta-coupling silver halide emulsion layer and at least one blue-sensitive yellow-coupling silver halide emulsion layer, a silver halide emulsion is provided in a coupler-free layer sensitized with another spectral sensitizer (a gap sensitizer) of which the sensitization maximum lies between the sensitization maxima of the red- and green-sensitive layers or the green- and blue-sensitive layers. More particularly, the sensitization maximum of the sensitizer of the coupler-free layer is at least 15 nm from the sensitization maxima of the green sensitizer and blue sensitizer and is at least 30 nm from the sensitization maximum of the red sensitizer.

The sensitization maximum is determined on the final material. To this end, the material containing the gap sensitizer is compared with an otherwise identical material which does not contain the gap sensitizer. The absorption maximum additionally occurring is the sensitization maximum of the gap sensitizer.

The gap sensitizer may be used in any quantity, but is preferably used in a quantity of 0.01 to 3 $\mu mol/m^2$. The sensitivity of the emulsion containing the "gap sensitizer" is preferably 0.5 to 3.0 log I.t units below the sensitivities of the emulsions or emulsion mixtures between whose sensitization maxima its sensitization maximum lies.

More particularly, a color-coupler-free interlayer between two dye-producing layers (coupler-containing, spectrally sensitized silver halide emulsion layers) is provided with a silver halide emulsion sensitized in accordance with the invention.

For example, the coupler-free interlayer between the yellow-coupling layer and the magenta-coupling layer contains a silver halide emulsion which has a sensitization maximum for the 495 to 530 nm range or for the 580 to 650 nm range. Similarly, the coupler-free interlayer between the magenta-coupling layer and the cyan-coupling layer may contain a silver halide emulsion which has a sensitization maximum for the 495 to 530 nm range or for the 580 to 650 nm range. Combinations of these embodiments are also possible.

It is preferred to use a silver halide emulsion sensitized for the 495 to 530 nm range and more particularly for the 495 to 510 nm range in the interlayer between the magenta-coupling silver halide emulsion layer and the cyan-coupling silver halide emulsion layer.

The color-coupler-free interlayer containing a silver halide emulsion sensitized with the gap sensitizer may contain compounds which, in an imagewise coupling reaction, release photographically active groups, such as development inhibitors and development accelerators, so-called DIR or DAR couplers and also DIR or DAR compounds in the effective quantities typical of such compounds. DIR compounds or DAR compounds are compounds which do not produce any dye during the coupling reaction.

This layer may contain otherwise typical constituents of any interlayer, for example binders and so-called DOP trappers, i.e. substances which react with the developer oxidation product to form stable, colorless substances, and also scavengers which reduce DOP.

In a particularly preferred embodiment, the material according to the invention is a material which contains at least one blue-sensitive silver halide emulsion layer containing at least one yellow coupler; an interlayer; at least one green-sensitive silver halide emulsion layer containing at least one magenta coupler; an interlayer; at least one red-sensitive silver halide emulsion layer containing at least one cyan coupler; and at least one protective layer in that order on a support, characterized in that the interlayer between the magenta-coupler containing silver halide emulsion layer and the cyan-coupling silver halide emulsion layer contains a silver halide emulsion sensitized for the 495 to 350 nm range.

The silver halides of the coupler-containing and coupler-free silver halide emulsion layers may be AgBr, AgBrCl, AgBrClI and AgCl.

In a preferred embodiment, the silver halides of all the photosensitive layers, including the interlayers according to the invention, contain at least 80 mol-% chloride, more particularly 95 to 100 mol-% chloride, 0 to 5 mol-% bromide and 0 to 1 mol-% iodide. The silver halide emulsions may be direct-positively working emulsions or, preferably, negatively working emulsions.

The silver halide may consist of predominantly compact crystals which may have, for example, a regular cubic or octahedral form or transitional forms. However, the crystals may also be twin crystals, for example platelet-like crystals in which the average diameter-to-thickness ratio is preferably at least 5:1, the diameter of a crystal being defined as the diameter of a circle with an area corresponding to the projected area of the crystal. However, the layers may also contain platy silver halide crystals in which the diameter-to-thickness ratio is considerably greater than 5:1, for example between 12:1 and 30:1.

The silver halide crystals may also have a multilayer structure, in the most simple case with an inner core and an outer shell (core/shell), the halide composition and/or other modifications, including for example doping of the individual crystal regions, being different. The average grain size of the emulsions is preferably between 0.2 μm and 2.0 μm and the grain size distribution may be both homodisperse and also heterodisperse. In addition to the silver halide, the emulsions may also contain organic silver salts, for example silver benztriazolate or silver behenate.

Two or more types of silver halide emulsion which have been separately prepared may be used in admixture.

The photographic emulsions may be prepared from soluble silver salts and soluble halides by various methods (cf. for example P. Glafkides, Chimie et Physique Photographique, Paul Montel, Paris (1967); G. F. Duffin, Photographic Emulsion Chemistry, The Focal Press, London (1966); V. L. Selikman et al, Making and Coating Photographic Emulsion, The Focal Press, London (1966)).

Precipitation of the silver halide is preferably carried out in the presence of the binder, for example gelatine, in the acidic, neutral or alkaline pH range, silver halide complexing agents preferably being additionally used. Silver halide complexing agents are, for example, ammonia, thioether, imidazole, ammonium thiocyanate or excess halide. The water-soluble silver salts and the halides are combined either successively by the single-jet process or simultaneously by the double-jet process or by any combination of both processes. The addition is preferably made at increasing inflow rates, although the "critical" feed rate at which new nuclei are still just not formed should not be exceeded. The pAg range may be varied within wide limits during precipitation. It is preferred to apply the so-called pAg-controlled method in which a certain pAg value is kept constant or the pAg value passes through a defined profile during precipitation. However, in addition to the preferred precipitation in the presence of an excess of halide, so-called inverse precipitation in the presence of an excess of silver ions is also possible. The silver halide crystals may be grown not only by precipitation, but also by physical ripening (Ostwald ripening) in the presence of excess halide and/or silver halide complexing agents. The emulsion grains may even be predominantly grown by Ostwald ripening, for which purpose a fine-grained, so-called Lippmann emulsion is preferably mixed with a less readily soluble emulsion and dissolved in and allowed to crystallize therefrom.

The silver halide crystals may be precipitated in the presence of growth modifiers, i.e. substances which influence growth in such a way that particular crystal forms and crystal surfaces (for example 111-surfaces in the case of AgCl) are formed.

Silver halide crystals which contain metal ions, particularly transition metal ions or complexes thereof, in their interior or at their surface are preferably used for the interlayer according to the invention. Salts or complexes of elements of groups 2a, 3a, 4a, 5a and 1b, 2b, 3b, 4b, 5b, 6b, 7b and 8b of the periodic system of elements are preferably used for doping the silver halides. The sensitivity and contrast of the interlayer can be adjusted as required in this way.

In addition, precipitation may even be carried out in the presence of sensitizing dyes. Complexing agents and/or dyes may be inactivated at any time, for example by changing the pH value or by an oxidative treatment.

Gelatine is preferably used as binder although it may be completely or partly replaced by other synthetic, semisynthetic or even naturally occurring polymers. Synthetic gelatine substitutes are, for example, polyvinyl alcohol, poly-N-vinyl pyrrolidone, polyacrylamides, polyacrylic acid and derivatives thereof, particularly copolymers. Naturally occurring gelatine substitutes are, for example, other proteins, such as albumin or casein, cellulose, sugar, starch or alginates. Semisynthetic gelatine substitutes are generally modified natural products. Cellulose derivatives, such as hydroxyalkyl cellulose, carboxymethyl cellulose, and phthalyl cellulose and also gelatine derivatives which have been obtained by reaction with alkylating or acylating agents or by grafting on of polymerizable monomers are examples of such modified natural products.

The binders should contain an adequate number of functional groups, so that sufficiently resistant layers can be produced by reaction with suitable hardeners. Functional groups of the type in question are, in particular, amino groups and also carboxyl groups, hydroxyl groups and active methylene groups.

The gelatine preferably used may be obtained by acidic or alkaline digestion. The production of such gelatines is described, for example, in The Science and Technology of Gelatine, edited by A. G. Ward and A. Courts, Academic Press 1977, pages 295 et seq. The particular gelatine used should contain as few photographically active impurities as possible (inert gelatine). Gelatines of high viscosity and low swelling are particularly advantageous. The gelatine may be partly or completely oxidized.

On completion of crystal formation or even at an earlier stage, the soluble salts are removed from the emulsion, for example by noodling and washing, by flocculation and washing, by ultrafiltration or by ion exchangers.

The photographic emulsions may contain compounds to prevent fogging or to stabilize the photographic function during production, storage and photographic processing.

Particularly suitable compounds of this type are azaindenes, preferably tetra- and pentaazaindenes, particularly those substituted by hydroxyl or amino groups. Compounds such as these are described, for example, by Birr, Z. Wiss. Phot. 4.7 (1952) pages 2 to 58. Other suitable antifogging agents are salts of metals, such as mercury or cadmium, aromatic sulfonic acids or sulfinic acids, such as benzenesulfinic acid, or nitrogen-containing heterocycles, such as nitrobenzimidazole, nitroindazole, (subs.) benztriazoles or benzthiazolium salts. Heterocycles containing mercapto groups are particularly suitable, examples of such compounds being mercaptobenzthiazoles, mercaptobenzimidazoles, mercaptotetrazoles, mercaptothiadiazoles, mercaptopyrimidines; these mercaptoazoles may even contain a water-solubilizing group, for example a carboxyl group or sulfo group. Other suitable compounds are published in Research Disclosure No. 17643 (1978), Chapter VI.

The stabilizers may be added to the silver halide emulsions before, during or after ripening. The compounds may of course also be added to other photographic layers associated with a silver halide layer.

Mixtures of two or more of the compounds mentioned may also be used.

The silver halide emulsions are normally chemically ripened, for example by the action of gold compounds or compounds of divalent sulfur.

The photographic emulsion layers or other hydrophilic colloid layers of the photosensitive material produced in accordance with the invention may contain surface-active agents for various purposes, such as coating aids, for preventing electrical charging, for improving surface slip, for emulsifying the dispersion, for preventing adhesion and for improving the photographic characteristics (for example development acceleration, high contrast, sensitization, etc.).

Suitable sensitizing dyes are cyanine dyes, more particularly those belonging to the following classes:

1. Red sensitizers

Dicarbocyanines with naphthothiazole or benzthiazole as basic terminal groups, which may be substituted in the 5- and/or 6-position by halogen, methyl, methoxy, and also 9,11-alkylene-bridged, more particularly 9,11-neopentylene thiadicarbocyanines bearing alkyl or sulfoalkyl substituents at the nitrogen.

2. Green sensitizers

9-Ethyloxacarbocyanines substituted in the 5-position by chlorine or phenyl and bearing alkyl or sulfoalkyl substituents, preferably sulfoalkyl substituents, at the nitrogen of the benzoxazole groups.

3. Blue sensitizers

Methine cyanines containing benzoxazole, benzthiazole, benzselenazole, naphthoxazole, naphthothiazole as basic terminal groups which are substituted in the 5- and/or 6-position by halogen, methyl, methoxy and which bear at least one and preferably two sulfoalkyl substituents at the nitrogen; also apomerocyanines containing a thiocyanine group.

Sensitizers for the 495 to 530 nm range may be representatives of the following classes of compounds represented by formulae I to XI, XXVI and XXVII:

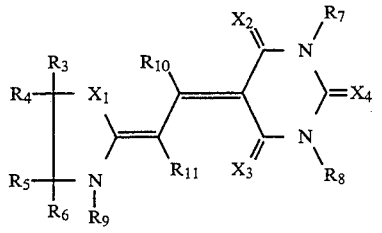
(I)

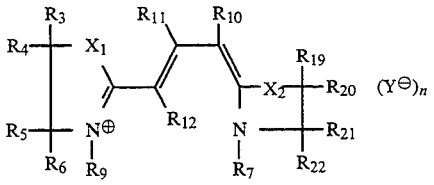
(II)

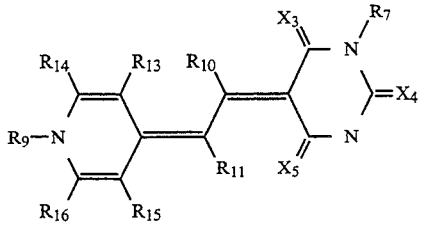
(III)

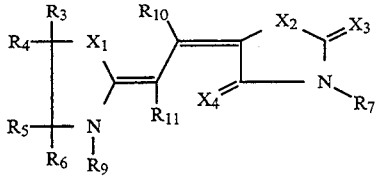
(IV)

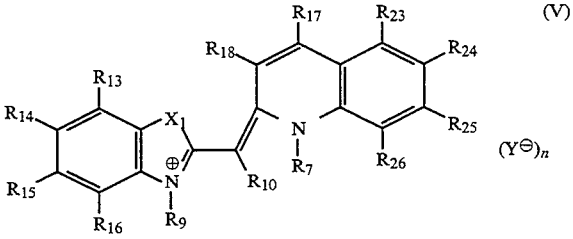
(V)

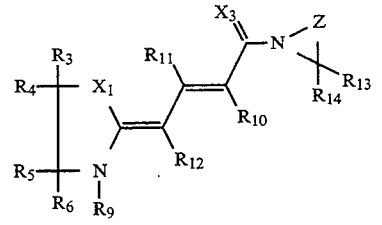
(VI)

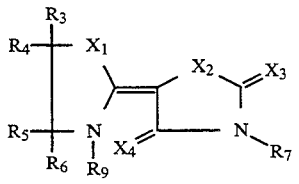
(VII)

-continued (VIII)

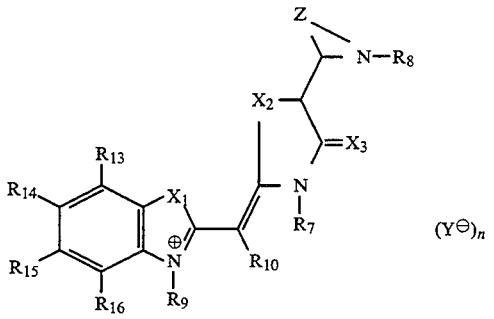

(IX)

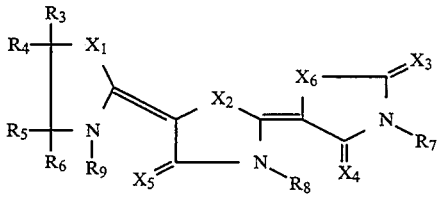

(X)

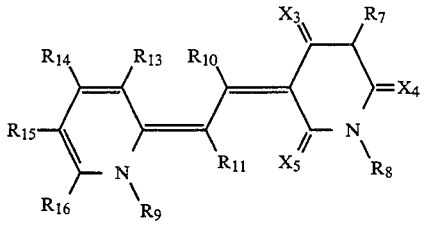

(XI)

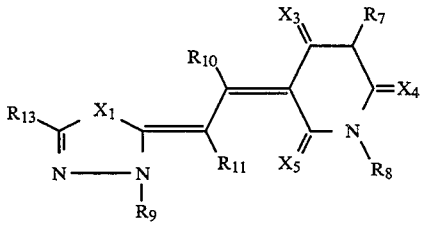

(XXVI)

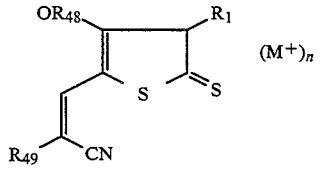

(XXVII)

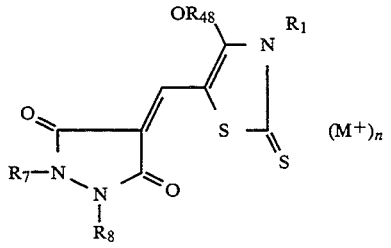

in which $X_1$–$X_6$ represent O, $NR_1$, S, Se, Te, $P(R_1)$, $P(R_1)_3$, $CH_2$, $CHR_2$, $C(R_2)_2$, $R_1$ represents alkyl, optionally substituted sulfoalkyl, carboxyalkyl, aryl, more particularly phenyl, $R_2$ represents aryl, more particularly phenyl, alkyl, more particularly containing 1 to 5 carbon atoms, CN, $R_3$,$R_4$,$R_5$,$R_6$,$R_{19}$, represent hydrogen, halogen, alkoxy, $R_{20}$,$R_{21}$,$R_{22}$ aryloxy, cyano-, hydroxy, sulfo, carboxy, alkoxycarbonyl, aryloxycarbonyl, acylaminosulfonyl, aminosulfonyl, alkylaminosulfonyl, dialkylaminosulfonyl, arylaminosulfonyl, diarylaminosulfonyl, aryl, arylmercapto, alkylmercapto or alkyl or $R_3$ and $R_6$ or $R_{19}$ and $R_{22}$ together form a $\pi$-bond $R_4$ and $R_5$ or $R_{20}$ and $R_{21}$ together form a 3 to 12-membered ring which may contain heteroatoms and multiple bonds, $R_7$,$R_8$,$R_9$ represent alkyl, optionally substituted sulfoalkyl, carboxyalkyl or aryl, $R_{10}$,$R_{11}$,$R_{12}$ represent hydrogen, halogen, cyano, aryl, aryloxy, arylmercapto, alkyl, alkoxy or alkylmercapto, $R_{13}$,$R_{14}$,$R_{15}$,$R_{16}$ represent hydrogen, halogen, alkoxy, $R_{17}$,$R_{18}$,$R_{23}$,$R_{24}$ cyano, hydroxy, sulfo, carboxy, $R_{25}$,$R_{26}$ alkoxycarbonyl, aryloxycarbonyl, acylaminosulfonyl, aminosulfonyl, alkylaminosulfonyl, arylaminosulfonyl, diarylaminosulfonyl, aryl, aryloxy, arylmercapto, alkyl or alkylmercapto, $R_{48}$ represents hydrogen, alkyl, sulfoalkyl, carboxyalkyl, acyl or a negative charge, $R_{49}$ represents —CN, $—CON(R_1)_2$ or $—SO_2R_1$, Z represents the remaining members of a 3- to 12-membered ring which may contain heteroatoms and double bonds, $M^{\oplus}$ represents a cation, $Y^{\oplus}$ is an anion and n=0 or 1.

Aryl and alkyl radicals may be further substituted. Acyl is in particular alkylcarbonyl or arylcarbonyl.

Substituents of sulfoalkyl are e.g. hydroxy and halogen, particularly chlorine.

The following are suitable examples of formulae I to XI and their sensitization maxima:

LS-I-1:

$X_1$, $X_2$, $X_3$=O, $X_4$=S, $R_3$ and $R_6$ together form a $\pi$ bond, $R_4$ and $R_5$ together represent —CH=CH—CH=CH—, $R_7$, $R_8$ represent $C_2H_5$, $R_9$, $R_{10}$ represent $CH_3$, $R_{11}$ represents H; 498;

LS-I-2:

$X_1$, $X_2$, $X_3$=O, $X_4$=S, $R_3$ and $R_6$ together form a $\pi$ bond, $R_4$ and $R_5$ together represent the remaining members of a 5-phenyl benzoxazole, $R_7$ represents $CH_3$, $R_8$ represents $C_2H_5$, $R_9$ represents $(CH_2)_3$—$SO_3H$, $R_{10}$ and $R_{11}$ represent H; 498;

LS-I-3:

$X_1$, $X_2$, $X_3$=O, $X_4$=S, $R_3$ and $R_6$ together form a $\pi$ bond, $R_4$ and $R_5$ together represent the remaining members of a 5-hydroxybenzoxazole, $R_8$ represents $CH_3$, $R_7$, $R_9$ represent $C_2H_5$, $R_{10}$, $R_{11}$ represent H; 495 nm;

LS-I-4:

$X_1$, $X_2$, $X_3$=O, $X_4$=S, $R_3$ and $R_6$ together form a $\pi$ bond, $R_4$ and $R_5$ together form the remaining members of a 5-chlorobenzoxazole, $R_7$, $R_8$ represent $CH_3$, $R_9$ represents $C_2H_5$, $R_{10}$, $R_{11}$ represent H; 495;

LS-I-5:

$X_1$, $X_2$, $X_3$=O, $X_4$=S, $R_3$ and $R_6$ together form a $\pi$ bond, $R_4$, $R_5$ represent 2-furyl, $R_7$ represents H, $R_8$, $R_9$ represent $CH_3$, $R_{10}$, $R_{11}$ represent H; 500;

LS-I-6:

$X_1$, $X_2$, $X_3$=O, $X_4$=S, $R_3$ and $R_6$ together form a $\pi$ bond, $R_4$, $R_5$ represent 2-furyl, $R_8$ represents H, $R_7$ represents $CH_3$, $R_9$ represents $(CH_2)_3$—$SO_3H$, $R_{10}$, $R_{11}$ represent H; 505;

LS-I-7:

$X_1$, $X_2$, $X_3$=O, $X_4$=S, $R_3$ and $R_6$ together form a $\pi$ bond, $R_4$, $R_5$ represent 2-furyl, $R_7$, $R_9$ represent $CH_3$, $R_8$ represents $C_2H_5$, $R_{10}$, $R_{11}$ represent H; 500;

LS-I-8:

$X_1$, $X_2$, $X_3$=O, $X_4$=S, $R_3$ and $R_6$ together form a $\pi$ bond, $R_4$, $R_5$ represent 2-furyl, $R_7$, $R_8$ represent $CH_3$, $R_9$ represents $(CH_2)_3$—$SO_3H$, $R_{10}$, $R_{11}$ represent H; 492;

LS-I-9:

$X_1$, $X_2$, $X_3$=O, $X_4$=S, $R_3$ and $R_6$ together form a $\pi$ bond, $R_4$, $R_5$ represent phenyl, $R_7$ represents $CH_3$, $R_8$ represents $C_2H_5$, $R_9$ represents 2-chloro-3-sulfopropyl, $R_{10}$, $R_{11}$ represent H; 493;

LS-I-10:

$X_1$, $X_2$, $X_3$=O, $X_4$=S, $R_3$ and $R_6$ together form a $\pi$ bond, $R_4$, $R_5$ represent phenyl, $R_7$ represents $CH_3$, $R_8$ represents $C_2H_5$, $R_9$ represents $(CH_2)_3$—$SO_3H$, $R_{10}$, $R_{11}$ represent H; 495;

LS-I-11:

$X_1$, $X_2$, $X_3$=O, $X_4$=S, $R_3$ and $R_6$ together form a $\pi$ bond, $R_4$, $R_5$ represent phenyl, $R_7$, $R_8$ represent $CH_3$, $R_9$ represents $C_2H_5$, $R_{10}$, $R_{11}$ represent H; 499;

LS-I-12:

$X_1$, $X_2$, $X_3$=O, $X_4$=S, $R_3$ and $R_6$ together form a $\pi$ bond, $R_4$, $R_5$ represent phenyl, $R_7$, $R_8$ represent $CH_3$, $R_9$ represents $CH_2$—COOH, $R_{10}$, $R_{11}$ represent H; 497;

LS-I-13:

$X_1$, $X_2$, $X_3$=O, $X_4$=S, $R_3$ and $R_6$ together form a $\pi$ bond, $R_4$ and $R_5$ together represent the remaining members of a 5-chlorobenzoxazole, $R_7$, $R_8$ represent $CH_3$, $R_9$ represents $(CH_2)_3SO_3H$, $R_{10}$, $R_{11}$ represent H; 495;

LS-II-14:

$X_1$, $X_2$=S, $R_3$ and $R_6$ together form a $\pi$ bond, $R_4$ and $R_5$ together represent —CH=CH—CH=CH—, $R_7$, $R_9$ represent $C_2H_5$, $R_9$, $R_{11}$, $R_{19}$, $R_{20}$, $R_{21}$, $R_{22}$ represent H, $R_{12}$ represents CN, $Y^{\ominus}$ represents $ClO_4^{\ominus}$, n=1; 500;

LS-II-15:

$X_1$, $X_2$=S, $R_3$, $R_4$, $R_5$, $R_6$, $R_{10}$, $R_{11}$, $R_{12}$ represent H, $R_{19}$ and $R_{22}$ together form a $\pi$ bond, $R_{20}$ represents N-morpholinocarb-onyl, $R_7$, $R_9$, $R_{21}$ represent $CH_3$, $Y^{\ominus}$ represents $I^{\ominus}$, n=1; 532;

LS-II-16:

$X_1$=O, $X_2$=S, $R_3$ and $R_6$ together form a $\pi$ bond, $R_4$ and $R_5$ together represent —CH=C($CH_3$)—C($CH_3$)=CH—, $R_7$ represents $CH_3$, $R_9$ represents $(CH_2)_3SO_3^{\ominus}$, $R_{10}$, $R_{11}$, $R_{12}$, $R_{19}$, $R_{20}$, $R_{21}$, $R_{22}$ represent H, n=0; 497;

LS-II-17:

$X_1$, $X_2$=S, $R_3$ and $R_6$ together form a $\pi$ bond, $R_4$ represents 2-hydroxyisopropyl, $R_5$, $R_7$, $R_9$ represent $CH_3$, $R_{10}$, $R_{11}$, $R_{12}$, $R_{19}$, $R_{20}$, $R_{21}$, $R_{22}$ represent H, $Y^{\ominus}$, represents $I^{\ominus}$, n=1; 505;

LS-II-18:

$X_1$, $X_2$=S, $R_{19}$ and $R_{22}$ together form a $\pi$ bond, $R_{20}$ represents $OC_2H_5$, $R_5$, $R_{10}$, $R_{11}$, $R_{12}$, $R_3$, $R_4$, $R_6$, $R_{21}$ represent H, $R_7$, $R_9$ represent $CH_3$, $Y^{\ominus}$ represents $I^{\ominus}$, n=1; 520;

LS-II-19:

$X_1$, $X_2$=S, $R_3$ and $R_6$ together form a $\pi$ bond, $R_4$ represents phenyl, $R_5$, $R_7$, $R_9$ represent $CH_3$, $R_{10}$, $R_{11}$, $R_{12}$, $R_{19}$, $R_{20}$, $R_{21}$, $R_{22}$ represent H, $Y^{\ominus}$ represents $I^{\ominus}$, n=1; 532;

LS-II-20:

$X_1$=O, $X_2$=S, $R_3$ and $R_6$ together form a $\pi$ bond, $R_4$ and $R_5$ together represent the remaining members of a 5-methyl benzoxazole, $R_7$ represents $CH_3$, $R_9$ represents $CH_2$—CH(Cl)—$CH_2$—$SO_3^{\ominus}$, $R_{10}$, $R_{11}$, $R_{12}$, $R_{19}$, $R_{20}$, $R_{21}$ and $R_{22}$ represent H, n=0; 492;

LS-II-21:

$X_1$, $X_2$=S, $R_{19}$ and $R_{22}$ together form a $\pi$ bond, $R_3$, $R_4$, $R_5$, $R_6$, $R_{10}$, $R_{11}$, $R_{12}$, $R_{20}$, $R_{21}$ represent H, $R_7$, $R_9$ represent $CH_3$, $Y^{\ominus}$ represents $I^{\ominus}$, n=1; 517;

LS-II-22:

$X_1$=O, $X_2$=S, $R_3$ and $R_6$ together represent a $\pi$ bond, $R_4$ and $R_5$ together represent the remaining members of a 5-phenyl benzoxazole, $R_7$, $R_9$ represent $CH_3$, $R_{10}$, $R_{11}$, $R_{12}$, $R_{19}$, $R_{20}$, $R_{21}$, $R_{22}$ represent H; $Y^{\ominus}$ represents $CH_3OSO_3^{\ominus}$, n=1; 492;

LS-II-23:

$X_1$, $X_2$=S, $R_{19}$ and $R_{22}$ together form a $\pi$ bond, $R_3$, $R_4$, $R_5$, $R_6$, $R_{10}$, $R_{11}$, $R_{12}$=H, $R_7$, $R_9$, $R_{20}$, $R_{21}$=$CH_3$, $Y^{\ominus}$ represents $I^{\ominus}$, n=1; 518;

LS-II-24:

$X_1$, $X_2$=S, $R_3$ and $R_6$ together form a $\pi$ bond, $R_4$ and $R_5$ together represent —CH=CH—CH=CH—, $R_7$ represents $C_2H_5$, $R_9$ represents $CH_3$, $R_{10}$, $R_{11}$, $R_{19}$, $R_{20}$, $R_{21}$, $R_{22}$ represent H, $R_{12}$ represents CN, $Y^{\ominus}$ represents $ClO_4^{\ominus}$, n=1; 500;

LS-II-25:

$X_1$, $X_2$=S, $R_{19}$ and $R_{22}$ together form a $\pi$ bond, $R_3$, $R_4$, $R_5$, $R_6$, $R_{10}$, $R_{11}$, $R_{12}$, $R_{20}$ represent H, $R_{21}$ represents phenyl, $R_7$, $R_9$ represent $C_2H_5$, $Y^{\ominus}$ represents $ClO_4^{\ominus}$, n=1; 520;

LS-II-26:

$X_1$, $X_2$=O, $R_3$ and $R_4$ together and $R_{19}$ and $R_{22}$ together form a $\pi$ bond, $R_4$, $R_{10}$, $R_{12}$, $R_{20}$ represent H, $R_5$, $R_{21}$ represent phenyl, $R_{11}$ represents $CH_3$, $R_7$ represents $(CH_2)_3SO_3^{\ominus}$, $R_9$ represents $(CH_2)_3SO_3H$, n=0; 515;

LS-II-27:

$X_1$, $X_2$=O, $R_3$ and $R_6$ together and $R_{19}$ and $R_{22}$ together form a $\pi$ bond, $R_4$, $R_{10}$, $R_{12}$, $R_{20}$ represent H, $R_5$, $R_{21}$ represent $CH_3$, $R_{11}$ represents $C_2H_5$, $R_7$ represents $(CH_2)_3SO_3^{\ominus}$, $R_9$ represents $(CH_2)_3SO_3H$, n=0; 500;

LS-II-28:

$X_1$, $X_2$=O, $R_3$ and $R_6$ together and $R_{19}$ and $R_{22}$ together form a $\pi$ bond, $R_4$, $R_{10}$, $R_{12}$, $R_{20}$ represent H, $R_5$, $R_{21}$ represent $CH_3$, $R_7$, $R_{11}$ represent $C_2H_5$, $R_9$ represents $(CH_2)_3SO_3^{\ominus}$, n=0; 498;

LS-II-29:

$X_1$, $X_2$=O, $R_3$ and $R_6$ together and $R_{19}$ and $R_{22}$ together form a $\pi$ bond, $R_4$, $R_{10}$, $R_{12}$, $R_{20}$ represent H, $R_5$, $R_{21}$ represent phenyl, $R_7$, $R_{11}$ represent $C_2H_5$, $R_9$ represents $(CH_2)_3SO_3^{\ominus}$, n=0; 513;

LS-II-30:

$X_1$, $X_2$=O, $R_3$ and $R_6$ together and $R_{19}$ and $R_{22}$ together form a $\pi$ bond, $R_4$, $R_{10}$, $R_{12}$, $R_{20}$ represent H, $R_5$, $R_{21}$ represent phenyl, $R_7$, $R_{11}$ represent $C_2H_5$, $R_9$ represents $(CH_2)_3SO_3^{\ominus}$, n=0; 513;

LS-II-31:

$X_1$, $X_2$=O, $R_3$ and $R_6$ together and $R_{19}$ and $R_{22}$ together form a $\pi$ bond, $R_4$, $R_{10}$, $R_{12}$, $R_{20}$ represent H, $R_5$, $R_{21}$ represent phenyl, $R_9$ represents $(CH_2)_3SO_3^{\ominus}$, $R_7$ represents $(CH_2)_3SO_3H$, $R_{11}$ represents $C_2H_5$, n=0; 515;

LS-II-32:

$X_1$, $X_2$=O, $R_3$ and $R_6$ together and $R_{19}$ and $R_{22}$ together form a $\pi$ bond, $R_4$, $R_5$, $R_{20}$, $R_{21}$, $R_{11}$ represent $CH_3$, $R_{10}$, $R_{12}$ represent H, $R_9$ represents $(CH_2)_3SO_3^{\ominus}$, $R_7$ represents $(CH_2)_3SO_3H$, n=0; 510;

LS-II-33:

$X_1$, $X_2$=O, $R_3$ and $R_6$ together and $R_{19}$ and $R_{22}$ together represent a $\pi$ bond, $R_4$, $R_5$, $R_{20}$, $R_{21}$ represent $CH_3$, $R_9$ represents $(CH_2)_3SO_3^{\ominus}$, $R_7$ represents $(CH_2)_3SO_3H$, $R_{10}$, $R_{12}$ represent H, $R_{11}$ represents $C_2H_5$, n=0; 510;

LS-II-34:

$X_1$, $X_2$=O, $R_3$ and $R_6$ together and $R_{19}$ and $R_{22}$ together form a $\pi$ bond, $R_4$, $R_{20}$ represent ethoxycarbonyl, $R_5$, $R_{21}$, $R_7$, $R_9$, $R_{11}$ represent $CH_3$, $R_{10}$, $R_{12}$ represent H, $Y^{\ominus}$ represents $ClO_4^{\ominus}$, n=1; 498;

LS-II-35:

$X_1$, $X_2$=O, $R_3$ and $R_6$ together and $R_{19}$ and $R_{22}$ together form a $\pi$ bond, $R_4$, $R_{20}$ represent ethoxycarbonyl, $R_5$, $R_7$, $R_9$, $R_{21}$ represent $CH_3$, $R_{10}$, $R_{11}$, $R_{12}$ represent H, $Y^{\ominus}$ represents $ClO_4^{\ominus}$, n=1, 502;

LS-H-36:

$X_1$, $X_2$=O, $R_3$ and $R_6$ together and $R_{19}$ and $R_{22}$ together form a $\pi$ bond, $R_4$, $R_{20}$ represent ethoxycarbonyl, $R_5$, $R_{21}$ represent $CH_3$, $R_7$ represents $(CH_2)_3SO_3^{\ominus}$, $R_9$ represents $(CH_2)_3SO_3H$, $R_{10}$, $R_{12}$ represents H, $R_{11}$ represents $C_2H_5$, n=0; 500;

LS-II-37:

$X_1$, $X_2$=O, $R_3$ and $R_6$ together and $R_{19}$ and $R_{22}$ together form a $\pi$ bond, $R_4$, $R_{20}$ represent ethoxycarbonyl, $R_5$, $R_{11}$, $R_{21}$ represent $CH_3$, $R_7$ represents $(CH_2)_3SO_3^{\ominus}$, $R_9$ represents $(CH_2)_3SO_3H$, $R_{10}$, $R_{12}$ represent H, n=0; 500;

LS-II-38:

$X_1$, $X_2$=O, $R_3$ and $R_6$ together and $R_{19}$ and $R_{22}$ together form a $\pi$ bond, $R_4$, $R_{20}$ represent ethoxycarbonyl, $R_5$, $R_{11}$, $R_{21}$ represent $CH_3$, $R_9$ represents $(CH_2)_3SO_3^{\ominus}$, $R_7$ represents $C_2H_5$, $R_{10}$, $R_{12}$ represent H, n=0; 499;

LS-II-39:

$X_1$, $X_2$=O, $R_3$ and $R_6$ together and $R_{19}$ and $R_{22}$ together form a $\pi$ bond, $R_4$, $R_{20}$ represent ethoxycarbonyl, $R_5$, $R_{21}$ represent $CH_3$, $R_9$ represents $(CH_2)_3SO_3^{\ominus}$, $R_7$, $R_{11}$ represent $C_2H_5$, $R_{10}$, $R_{12}$ represent H, n=0; 499;

LS-II-40:

$X_1$, $X_2$=O, $R_3$ and $R_6$ together and $R_{19}$ and $R_{22}$ together form a $\pi$ bond, $R_4$, $R_5$, $R_{11}$, $R_{21}$, $R_{21}$ represent $CH_3$, $R_9$ represents $(CH_2)_3SO_3^{\ominus}$, $R_7$ represents $C_2H_5$, $R_{10}$, $R_{12}$ represent H, n=0; 508;

LS-II-41:

$X_1$, $X_2$=O, $R_3$ and $R_6$ together and $R_{19}$ and $R_{22}$ together form a $\pi$ bond, $R_4$, $R_5$, $R_{20}$, $R_{21}$ represent $CH_3$, $R_9$ represents $(CH_2)_3SO_3^{\ominus}$, $R_7$, $R_{11}$ represent $C_2H_5$, $R_{10}$, $R_{12}$ represent H, n=0; 508;

LS-II-42:

$X_1$=S, $X_2$=O, $R_{19}$ and $R_{22}$ together form a $\pi$ bond, $R_{20}$ and $R_{21}$ represent the remaining members of a 5-phenyl benzoxazole, $R_9$ represents $(CH_2)_3SO^{\ominus}$, $R_7$, $R_{11}$ represent $C_2H_5$, $R_{10}$, $R_{12}$, $R_3$, $R_4$, $R_5$, $R_6$ represent H, n=0; 502;

LS-II-43:

$X_1$=S, $X_2$=O, $R_{19}$ and $R_{22}$ together form a $\pi$ bond, $R_{20}$ and $R_{21}$ represent the remaining members of a 5-chlorobenzoxazole, $R_9$ represents $(CH_2)_3SO_3^{\ominus}$, $R_7$, $R_{11}$ represent $C_2H_5$, $R_{10}$, $R_{12}$, $R_3$, $R_4$, $R_5$, $R_6$ represent H, n=0; 498;

LS-II-44:

$X_1$, $X_2$=S, $R_{19}$ and $R_{22}$ together form a $\pi$ bond, $R_3$, $R_4$, $R_5$, $R_6$, $R_{10}$, $R_{12}$, $R_{20}$ represent H, $R_{21}$ represents phenyl, $R_9$ represents $(CH_2)_3SO_3^{\ominus}$, $R_7$ represents $(CH_2)_3SO_3H$, $R_{11}$ represents $C_2H_5$, n=0; 505;

LS-II-45:

$X_1$, $X_2$=S, $R_{19}$ and $R_{22}$ together form a $\pi$ bond, $R_3$, $R_4$, $R_5$, $R_6$, $R_{10}$, $R_{12}$, $R_{20}$ represent H, $R_{21}$ represents Cl, $R_9$ represents $(CH_2)_3SO_3^{\ominus}$, $R_7$ represents $(CH_2)_3SO_3H$, $R_{11}$ represents $C_2H_5$, n=0; 502;

LS-II-46:

$X_1$, $X_2$=S, $R_{19}$ and $R_{22}$ together form a $\pi$ bond, $R_{20}$, $R_{21}$ represent $CH_3$, $R_9$ represents $(CH_2)_3SO_3^{\ominus}$, $R_7$ represents $(CH_2)_3SO_3H$, $R_3$, $R_4$, $R_5$, $R_6$, $R_{10}$, $R_{12}$ represent H, $R_{11}$ represents $C_2H_5$, n=0; 520;

LS-II-47:

$X_1$, $X_2$=S, $R_{19}$ and $R_{21}$ together form a $\pi$ bond, $R_{20}$, $R_{21}$ represent $CH_3$, $R_9$ represents $(CH_2)_3SO_3^{\ominus}$, $R_7$, $R_{11}$ represent $C_2H_5$, $R_3$, $R_4$, $R_5$, $R_6$, $R_{10}$, $R_{12}$ represent H, n=0; 520;

LS-III-48:

$X_3$, $X_5$=O, $X_4$=S, $R_7$, $R_8$, $R_9$ represent $CH_3$, $R_{10}$, $R_{11}$, $R_{13}$, $R_{14}$, $R_{15}$, $R_{16}$ represent H: 497;

LS-III-49:

$X_3$, $X_5$=O, $X_4$=S, $R_7$ represents $(CH_2)_3SO_3H$, $R_8$, $R_9$ represent $CH_3$, $R_{10}$, $R_{11}$, $R_{13}$, $R_{14}$, $R_{15}$, $R_{16}$ represent H; 500;

LS-III-50:

$X_3$, $X_5$=O, $X_4$=S, $R_7$, $R_5$ represent $(CH_2)_3SO_3H$, $R_9$ represents $CH_3$, $R_{10}$, $R_{11}$, $R_{13}$, $R_{14}$, $R_{15}$, $R_{16}$ represent H; 505;

LS-III-51:

$X_3$, $X_5$=O, $X_4$=S, $R_7$, $R_8$ represent $CH_3$, $R_9$ represents $(CH_2)_3SO_3H$, $R_{10}$, $R_{11}$, $R_{13}$, $R_{14}$, $R_{15}$, $R_{16}$ represent H; 500;

LS-IV-52:

$X_1$, $X_3$=S, $X_2$, $X_4$=O, $R_3$, $R_4$, $R_5$, $R_6$, $R_{10}$, $R_{11}$ represent H, $R_7$, $R_9$ represent $C_2H_5$; 500;

LS-IV-53:

$X_1$, $X_3$=S, $X_2$, $X_4$=O, $R_3$, $R_4$, $R_5$, $R_6$, $R_{10}$, $R_{11}$ represent H, $R_7$ represents $C_2H_5$, $R_9$ represents $CH_3$; 500;

LS-IV-54:

$X_1$, $X_3$=S, $X_2$, $X_4$=O, $R_3$, $R_4$, $R_5$, $R_6$, $R_{10}$, $R_{11}$ represent H, $R_7$ represents $C_2H_5$, $R_9$ represents $(CH_2)_3SO_3H$; 500;

LS-IV-55:

$X_1$, $X_3$=S, $X_2$, $X_4$=O, $R_3$, $R_4$, $R_5$, $R_6$, $R_{10}$, $R_{11}$ represent H, $R_7$ represents $(CH_2)_3SO_3H$, $R_9$ represents $C_2H_5$; 500;

LS-IV-56:

$X_1$=$CH_2$, $X_2$, $X_3$=S, $X_4$=O, $R_3$, $R_4$, $R_5$, $R_6$, $R_{11}$ represent H, $R_7$ represents $C_2H_5$, $R_9$ represents $(CH_2)_2CH(CH_3)SO_3H$, $R_{10}$ represents $CH_3$; 523;

LS-IV-57:

$X_1$=$CH_2$, $X_2$, $X_3$=S, $X_4$=O, $R_3$, $R_4$, $R_5$, $R_6$, $R_{11}$ represent H, $R_7$, $R_{10}$ represent $C_2H_5$, $R_9$ represents $(CH_2)_2CH(CH_3)SO_3H$; 522;

LS-IV-58:

$X_1=CH_2$, $X_2=NCH_3$, $X_3=S$, $X_4=O$, $R_3$, $R_4$, $R_5$, $R_6$, $R_{10}$, $R_{11}$ represent H, $R_7$ represents $CH_3$, $R_9$ represents $(CH_2)_3SO_3H$; 500;

LS-IV-59:

$X_1=CH_2$, $X_2=NCH_3$, $X_3=S$, $X_4=O$, $R_3$, $R_4$, $R_5$, $R_6$, $R_{10}$, $R_{11}$ represent H, $R_7$, $R_9$ represent $CH_3$; 495;

LS-V-60:

$X_1=O$, $R_7$ represents $C_2H_5$, $R_9$ represents $(CH_2)_4SO_3^{\ominus}$, $R_{10}$, $R_{13}$, $R_{14}$, $R_{16}$, $R_{17}$, $R_{18}$, $R_{23}$, $R_{25}$, $R_{26}$ represent H, $R_{15}$ represents phenyl, $R_{24}$ represents $OCH_3$, n=0; 500;

LS-V-61:

$X_1=O$, $R_7$, $R_9$ represent $C_2H_5$, $R_{10}$, $R_{13}$, $R_{14}$, $R_{16}$, $R_{17}$, $R_{18}$, $R_{23}$, $R_{25}$, $R_{26}$ represent H, $R_{15}$ represents phenyl, $R_{24}$ represents $OCH_3$, $Y^{\ominus}$ represents $I^{\ominus}$, n=1; 500;

LS-V-62:

$X_1=O$, $R_7$ represents $C_2H_5$, $R_9$ represents $(CH_2)_3SO_3^{\ominus}$, $R_{10}$, $R_{13}$, $R_{14}$, $R_{16}$, $R_{17}$, $R_{18}$, $R_{23}$, $R_{25}$, $R_{26}$ represent H, $R_{15}$ represents phenyl, $R_{24}$ represents $OCH_3$, n=0; 500;

LS-V-63:

$X_1=O$, $R_7$ represents $C_2H_5$, $R_9$ represents $(CH_2)_2SO_3^{\ominus}$, $R_{10}$, $R_{13}$, $R_{14}$, $R_{16}$, $R_{17}$, $R_{18}$, $R_{23}$, $R_{25}$, $R_{26}$ represent H, $R_{15}$ represents phenyl, $R_{24}$ represents $OCH_3$, n=0; 500;

LS-V-64:

$X_1=O$, $R_7$ represents $(CH_2)_3SO_3H$, $R_9$ represents $(CH_2)_3SO_3^{\ominus}$, $R_{10}$, $R_{13}$, $R_{14}$, $R_{16}$, $R_{17}$, $R_{18}$, $R_{23}$, $R_{25}$, $R_{26}$ represent H, $R_{15}$ represents phenyl, $R_{24}$ represents $OCH_3$, n=0; 505;

LS-V-65:

$X_1=O$, $R_7$ represents $(CH_2)_3SO_3H$, $R_9$ represents $(CH_2)_2SO_3^{\ominus}$, $R_{10}$, $R_{13}$, $R_{14}$, $R_{16}$, $R_{17}$, $R_{18}$, $R_{23}$, $R_{25}$, $R_{26}$ represent H, $R_{15}$ represents phenyl, $R_{24}$ represents $OCH_3$, n=0; 505;

LS-V-66:

$X_1=O$, $R_7$ represents $C_2H_5$, $R_9$ represents $(CH_2)_3SO_3^{\ominus}$, $R_{10}$, $R_{13}$, $R_{14}$, $R_{10}$, $R_{17}$, $R_{18}$, $R_{23}$, $R_{25}$, $R_{26}$ represent H, $R_{15}$ represents chlorine, $R_{24}$ represents $OCH_3$, n=0; 500;

LS-V-67:

$X_1=O$, $R_7$ represents $(CH_2)_3SO_3H$, $R_9$ represents $(CH_2)_3SO_3^{\ominus}$, $R_{10}$, $R_{13}$, $R_{14}$, $R_{16}$, $R_{17}$, $R_{18}$, $R_{23}$, $R_{25}$, $R_{26}$ represent H, $R_{15}$ represents chlorine, $R_{24}$ represents $OCH_3$, n=0; 503;

LS-V-68:

$X_1=S$, $R_7$, $R_9$ represent $C_2H_5$, $R_{10}$, $R_{13}$, $R_{14}$, $R_{16}$, $R_{23}$, $R_{25}$, $R_{26}$ represent H, $R_{15}$ represents $SO_3^{\ominus}$, n=0; 500;

LS-VI-69:

$X_1=O$, $X_3=S$, Z represents $—CH_2—CH_2—CH_2—$, $R_3$ and $R_6$ together form a $\pi$ bond, $R_4$ and $R_5$ together represent —CH=CH—CH=CH—, $R_9$ represents $(CH_2)_3SO_3H$, $R_{10}$ represents CN, $R_{11}$, $R_{12}$, $R_{13}$, $R_{14}$ represent H; 500;

LS-VI-70:

$X_1=O$, $X_3=S$, Z represents $—CH_2—CH_2—CH_2—$, $R_3$ and $R_6$ together form a $\pi$ bond, $R_4$ and $R_5$ together form the remaining members of a 5-phenyl benzoxazole, $R_9$ represents $(CH_2)_3SO_3H$, $R_{10}$ represents CN, $R_{11}$, $R_{12}$, $R_{13}$, $R_{14}$ represent H; 510;

LS-VI-71:

$X_1=O$, $X_3=S$, Z represents $—CH_2—CH_2—CH_2—$, $R_3$ and $R_6$ together form a $\pi$ bond, $R_4$ and $R_5$ together represent the remaining members of a 5-chlorobenzoxazole, $R_9$ represents $(CH_2)_3SO_3H$, $R_{10}$ represents CN, $R_{11}$, $R_{12}$, $R_{13}$, $R_{14}$ represent H; 505;

LS-VI-72:

$X_1=O$, $X_3=S$, Z represents $—CH_2—CH_2—CH_2—$, $R_3$ and $R_6$ together form a $\pi$ bond, $R_4$ and $R_5$ together represent the remaining members of a 5-phenylbenzoxazole, $R_9$ represents $(CH_2)_2SO_3H$, $R_{10}$ represents CN, $R_{11}$, $R_{12}$, $R_{13}$, $R_{14}$ represent H; 510;

LS-VII-73:

$X_1$, $X_2$, $X_3=S$, $X_4=O$, $R_3$ and $R_6$ together form a $\pi$ bond, $R_4$ represents $C_2H_5OCOCH=CH—$, $R_5$, $R_9$ represent $CH_3$, $R_7$ represents $HOOC—CH_2$; 495;

LS-VII-74:

$X_1$, $X_2$, $X_3=S$, $X_4=O$, $R_3$ and $R_6$ together form a $\pi$ bond, $R_4$ represents H, $R_5$ represents $CH_3$, $R_7$ represents $HOOC—CH_2$, $R_9$ represents $(CH_2)_3SO_3H$; 495;

LS-VII-75:

$X_1$, $X_2$, $X_3=S$, $X_4=O$, $R_3$ and $R_6$ together form a $\pi$ bond, $R_4$ represents H, $R_5$, $R_9$ represent $CH_3$, $R_7$ represents $(CH_2)_3SO_3H$; 495;

LS-VII-76:

$X_1$, $X_2$, $X_3=S$, $X_4=O$, $R_3$ and $R_6$ together form a $\pi$ bond, $R_4$ represents H, $R_5$ represents $CH_3$, $R_7$ represents $C_2H_5$, $R_9$ represents $(CH_2)_3SO_3H$; 495;

LS-VIII-77:

$X_1$, $X_2=S$, $X_3=O$, Z represents $—CH_2—CH_2—CH_2—$, $R_7$, $R_9$ represents $C_2H_5$, $R_8$ represents $C_4H_9$, $R_{10}$, $R_{15}$, $R_{16}$ represent H, $R_{13}$ and $R_{14}$ together represent —CH=CH—CH=CH—, $Y^{\ominus}$ represents $NO_3^{\ominus}$, n=1; 498;

LS-VIII-78:

$X_1$, $X_2=S$, $X_3=O$, Z represents $—CH_2—CH_2—CH_2—$, $R_7$ represents $(CH_2)_3SO_3^{\ominus}$, $R_5$, $R_9$ represent $C_2H_5$, $R_{10}$, $R_{15}$, $R_{16}$ represent H, $R_{13}$ and $R_{14}$ together represent —CH=CH—CH=CH—, n=0; 500;

LS-VIII-79:

$X_1$, $X_2=S$, $X_3=O$, Z represents $—CH_2—CH_2—CH_2—$, $R_7$ represents $(CH_2)_3SO_3^{\ominus}$, $R_8$ represents $C_2H_5$, $R_9$ represents $(CH_2)_3SO_3H$, $R_{10}$, $R_{15}$, $R_{16}$ represent H, $R_{13}$ and $R_{14}$ together represent —CH=CH—CH=CH—, n=0; 503;

LS-IX-80:

$X_1=NCH_3$, $X_2$, $X_3=S$, $X_4$, $X_5$, $X_6=O$, $R_3$ and $R_6$ together form a $\pi$ bond, $R_4$ and $R_5$ together represent —CH=CH—CH=CH—, $R_7$, $R_9$ represent $CH_3$, $R_5$ represents $C_2H_5$; 505;

LS-IX-81:

$X_1=NCH_3$, $X_2$, $X_6=S$, $X_3=C(CN)_2$, $X_4$, $X_5=O$, $R_3$ and $R_6$ together form a $\pi$ bond, $R_4$ and $R_5$ together represent —CH=CH—CH=CH—, $R_7$, $R_8$ represent $C_2H_5$, $R_9$ represents $(CH_2)_3SO_3H$; 520;

LS-IX-82:

$X_1=NCH_3$, $X_2$, $X_6=S$, $X_3=C(CN)_2$, $X_4$, $X_5=O$, $R_3$ and $R_6$ together form a $\pi$ bond, $R_4$ and $R_5$ together represent —CH=CH—CH=CH—, $R_7$, $R_8$ represent $C_2H_5$, $R_9$ represents $CH_3$; 520;

LS-IX-83:

$X_1=NCH_3$, $X_2$, $X_3=S$, $X_4$, $X_5$, $X_6=O$, $R_3$ and $R_6$ together form a $\pi$ bond, $R_4$ and $R_5$ together represent —CH=CH—CH=CH—, $R_7$ represents $CH_3$, $R_8$ represents $C_2H_5$, $R_9$ represents $(CH_2)_3SO_3H$; 508;

LS-IX-84:

$X_1$, $X_2$, $X_4$, $X_5$=O, $X_3$, $X_6$=S, $R_3$ and $R_6$ together form a $\pi$ bond, $R_4$, $R_5$ represent 2-furyl, $R_7$, $R_8$ represent $C_2H_5$, $R_9$ represents $CH_3$; 500;

LS-IX-85:

$X_1$, $X_2$, $X_4$, $X_5$=O, $X_3$, $X_6$=S, $R_3$ and $R_6$ together form a $\pi$ bond, $R_4$, $R_5$ represent phenyl $R_7$, $R_8$ represent $C_2H_5$, $R_9$ represents $(CH_2)_3SO_3H$; 498;

LS-IX-86:

$X_1$, $X_2$, $X_4$, $X_5$=O, $X_3$, $X_6$=S, $R_3$ and $R_6$ together form a $\pi$ bond, $R_4$, $R_5$ represent $CH_3$, $R_7$, $R_8$ represent $C_2H_5$, $R_9$ represents $(CH_2)_3SO_3H$; 495;

LS-IX-87:

$X_1$, $X_2$, $X_4$, $X_5$=O, $X_3$, $X_6$=S, $R_3$ and $R_6$ together form a $\pi$ bond, $R_4$, $R_5$ represent 2-furyl, $R_7$, $R_8$ represent $C_2H_5$, $R_9$ represents $(CH_2)_3SO_3H$; 502;

LS-X-88:

$X_3$, $X_5$=O, $X_4$=S, $R_7$, $R_8$, $R_9$ represent $C_2H_5$, $R_{10}$, $R_{11}$, $R_{13}$, $R_{14}$, $R_{15}$, $R_{16}$ represent H; 498;

LS-X-89:

$X_3$, $X_5$=O, $X_4$=S, $R_7$, $R_{10}$, $R_{11}$, $R_{13}$, $R_{14}$, $R_{15}$, $R_{16}$ represent H, $R_8$, $R_9$ represent $CH_3$; 490;

LS-X-90:

$X_3$, $X_5$=O, $X_4$=S, $R_7$, $R_8$, $R_9$ represent $CH_3$, $R_{10}$, $R_{11}$, $R_{13}$, $R_{14}$, $R_{15}$, $R_{16}$ represent H; 500;

LS-X-91:

$X_3$, $X_5$=O, $X_4$=S, $R_7$, $R_8$ represent $CH_3$, $R_9$ represents $(CH_2)_3SO_3H$, $R_{10}$, $R_{11}$, $R_{13}$, $R_{14}$, $R_{15}$, $R_{16}$ represent H; 503;

LS-XI-92:

$X_1$, $X_4$=S, $X_3$, $X_5$=O, $R_7$, $R_8$ represent $C_2H_5$, $R_9$, $R_{10}$ represent $CH_3$, $R_{11}$ represents H, $R_{13}$ represents $CH_3S$; 500;

LS-XI-93:

$X_1$, $X_4$=S, $X_3$, $X_5$=O, $R_7$, $R_8$, $R_9$ represent $CH_3$, $R_{10}$, $R_{11}$ represent H, $R_{13}$ represents $CH_3S$; 505;

LS-XI-94:

$X_1$, $X_4$=S, $X_3$, $X_5$=O, $R_7$, $R_{13}$ represent $CH_3$, $R_8$ represents $C_2H_5$, $R_9$ represents $(CH_2)_3SO_3H$, $R_{10}$, $R_{11}$ represent H; 495;

LS-XI-95:

$X_1$, $X_4$=S, $X_3$, $X_5$=O, $R_7$, $R_8$ represent $CH_3$, $R_9$ represents $(CH_2)_3SO_3H$, $R_{10}$, $R_{11}$ represent H, $R_{13}$ represents phenyl; 502.

LS-I-134:

$X_1$, $X_2$, $X_3$=, $X_4$=S, $R_3$ and $R_6$ together denote a $\pi$ bond, $R_4$ and $R_5$ together denote the remaining members of a 5-carboxymethylen-benzoxazole (pyridiniumsalt), $R_7$ denotes $CH_3$, $R_8$, $R_9$ denote $C_2H_5$, $R_{10}$, $R_{11}$ denote H; 495 nm;

LS-II-135:

$X_1$=O, $X_2$=S, $R_3$ and $R_6$ together denote a $\pi$ bond, $R_4$ and $R_5$ together denote the remaining members of a 5-carboxymethylenbenzoxazole, $R_7$ $CH_3$, $R_9$ $C_2H_5$, $R_{10}$, $R_{11}$, $R_{12}$, $R_{19}$, $R_{20}$, $R_{21}$, $R_{22}$ H, $Y^{\ominus}$ $I^{\ominus}$, n=1; 500;

LS-II-136:

$X_1$, $X_2$=O, $R_3$ and $R_6$ together and $R_{19}$ and $R_{22}$ together denote the $\pi$ bond, $R_4$ and $R_5$ together and $R_{20}$ and $R_{21}$ together denote the remaining bonds of a 5-benzoyloxybenzoxazols, $R_7$, $R_9$ $C_2H_5$, $R_{10}$, $R_{11}$, $R_{12}$ H, $Y^{\ominus}$ $C_2H_5OSO_3^{\ominus}$, n=1; 513;

LS-XXVI-137:

$R_1$ $C_2H_5$, $R_{48}$ denotes a negative charge, $R_{49}$ denotes CN, $M^+$ $K^+$, n=1; 495;

LS-XXVI-138:

$R_1$ $C_2H_5$, $R_{48}$ denotes a negative charge, $R_{49}$ denotes $—CONH_2$, $M^+Na^+$, n=1; 500;

LS-XXVI-139:

$R_1$ $C_2H_5$, $R_{48}$ H, $R_{49}$ $—CONH_2$, n=O; 500;

LS-XXVI-140:

$R_1$ $C_2H_5$, $R_{48}$ denotes a negative charge, $R_{49}$ $—CONHC_2H_5$, $M^+$ $HN^+$ $(C_2H_5)_3$, n=1; 500;

LS-XXVI-141:

$R_1$ $C_2H_5$, $R_{48}$ denotes a negative charge, $R_{49}$

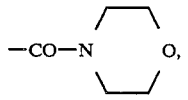

$M^+Na^+$, n=1; 500;

LS-XXVI-142:

$R_1$ $C_2H_5$, $R_{48}$ denotes a negative charge, $R_{49}$ $CONHCH_2—CH=CHa_2$, $M^+Na^+$, n=1; 500;

LS-XXVI-143:

$R_1$ $C_2H_5$, $R_{48}$ denotes a negative charge, $R_{49}$ $CONHCH_2CH_2OH$, $M^+K^+$, n=1; 500;

LS-XXVI-144:

$R_1$ H, $R_{48}$ denotes a negative charge, $R_{49}$ $CONH_2$, $M^+K^+$, n=1; 500;

LS-XXVI-145:

$R_1$ H, $R_{48}$ denotes a negative charge, $R_{49}$ CONH-phenyl, $M^+K^+$, n=1; 510;

LS-XXVI-146:

$R_1$ ethyl, $R_{48}$ denotes a negative charge, $R_{49}$ $SO_2$-phenyl, $M^+K^+$, n=1; 495;

LS-XXVII-147:

$R_1$ $CH_2COOC_2H_5$, $R_7$, $R_8$ phenyl, $R_{48}$ denotes a negative charge, $M^+HN^+(C_2H_5)_3$, n=1; 500;

LS-XXVII-148:

$R_1$ $CH_2COOC_2H_5$, $R_7$, $R_8$ phenyl, $R_{48}$ denotes a negative charge, $M^+HN^{\oplus}(C_2H_5)_3$, n=1; 500;

LS-XXVII-149:

$R_1$ $C_2H_5$, $R_7$, $R_8$ phenyl, $R_{48}$ denotes a negative charge, $M^+HN^+(C_2H_5)_3$, n=1; 500;

LS-XXVII-150:

$R_1$, $R_7$, $R_8$ phenyl, $R_{48}$ denotes a negative charge, $M^+HN^+(C_2H_5)_3$, n=1; 500.

Compounds corresponding to formulae I, II, III, IV, V, X and XI are preferred. Among the compounds I, those corresponding to formula XII are preferred:

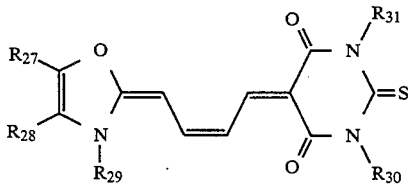

(XII)

Among the compounds II, those corresponding to formulae XIII and XIV are preferred:

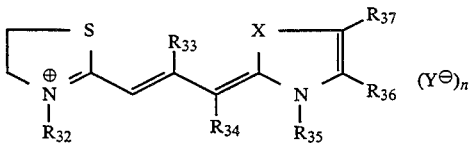

(XIII)

-continued

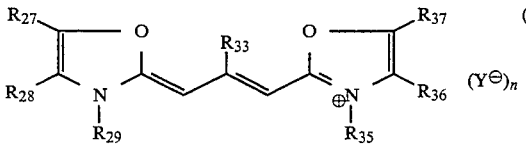

(XIV)

Among the compounds III, those corresponding to formula XV are preferred:

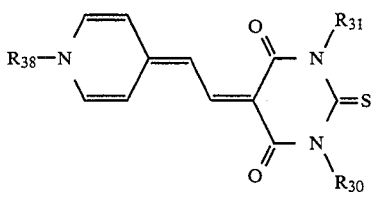

(XV)

Among the compounds IV, those corresponding to formula XVI are preferred:

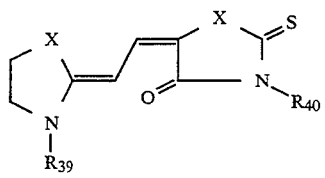

(XVI)

Among the compounds V, those corresponding to formula XVII are preferred:

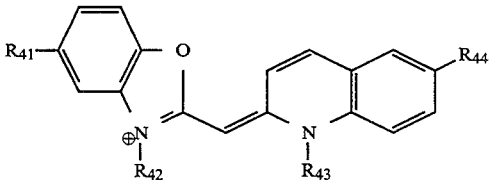

(XVII)

Among the compounds X, those corresponding to formula XVIII are preferred:

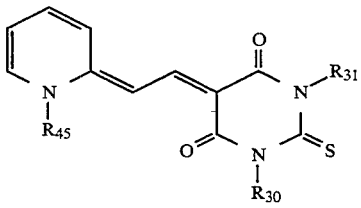

(XVIII)

Among the compounds XI, those corresponding to formula XIX are preferred:

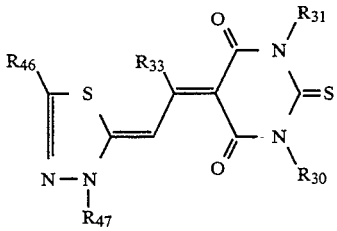

(XIX)

In these formulae, the substituents have the following meanings:

X: O, S, Se, $NR_1$;

$R_{27}$,$R_{28}$: H, $CH_3$, phenyl, 2-furyl, Cl, methoxycarbonyl, ethoxycarbonyl;

$R_{29}$,$R_{32}$,$R_{35}$,$R_{38}$,$R_{39}$,$R^{40}$,$R^{42}$,$R^{43}$,$R^{45}$,$R^{47}$: methyl, ethyl, optionally substitute sulfoalkyl, carboxyalkyl;

$R_{30}$,$R_{31}$: hydrogen or $R_{29}$;

$R_{33}$: hydrogen, methyl, ethyl;

$R_{34}$: H, CN;

$R_{36}$,$R_{37}$: H, $CH_3$, $C_2H_5$, phenyl, ethoxy, morpholinocarbonyl, 1-hydroxyisopropyl, Cl, methoxycarbonyl, ethoxycarbonyl;

$R_{41}$: H, Cl, $CH_3$, OH, $OCH_3$, phenyl;

$R_{44}$: H, $OCH_3$;

$R_{46}$: H, $CH_3$, $SCH_3$, Cl, phenyl.

Sensitizers for the 580 to 650 nm absorption range may be represensitives of the following dye classes represented by formulae XX to XXII:

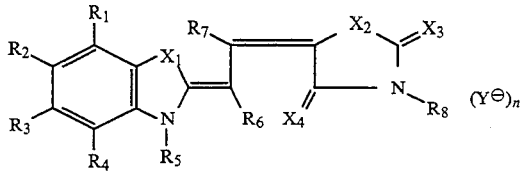

(XX)

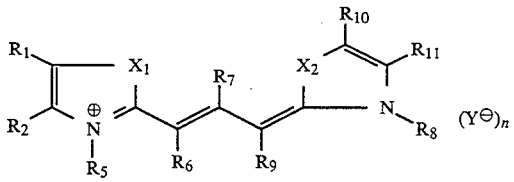

(XXI)

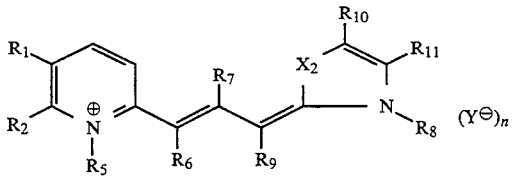

(XXII)

in which $R_1$,$R_2$,$R_3$,$R_4$,$R_{10}$ and $R_{11}$ represent hydrogen, halogen, alkoxy, aryloxy, cyano, hydroxy, sulfo, carboxy, alkoxycarbonyl, aryloxycarbonyl, acyl aminosulfonyl, aminosulfonyl, alkylaminosulfonyl, dialkyl aminosulfonyl, aryl aminosulfonyl, diaryl aminosulfonyl, aryl, arylmercapto, alkylmercapto or alkyl or $R_1$ and $R_2$ together or $R_2$ and $R_3$ together or $R_3$ and $R_4$ together or $R_{10}$ and $R_{11}$ together form an aromatic or heteroaromatic 3-to 12-membered ring, more particularly a fused benzo or naphtho ring, $R_5$,$R_8$ represent aryl, alkyl, optionally substituted sulfoalkyl, carboxyalkyl, $R_6$,$R_7$,$R_9$ represent hydrogen, halogen, cyano, aryl, arylmercapto, aryloxy, alkyl, alkylmercapto or alkoxy, $X_1$,$X_2$,$X_3$,$X_4$ represent O, NR, S, Se, Te, PR, $PR_3$, $CH_2$, CH alkyl, $C(alkyl)_2$, CH aryl, $C(aryl)_2$, $Y^{\ominus}$ is an anion and n=0 or 1.

Preferred compounds XX to XXII correspond to formulae XXIII, XXIV and XXV:

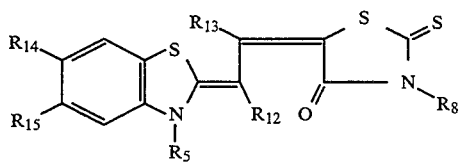

(XXIII)

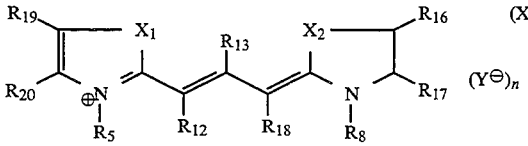

(XXIV)

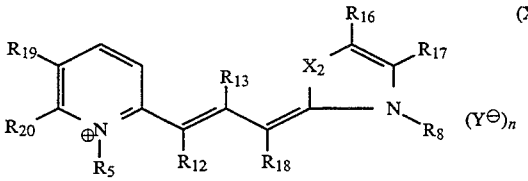

(XXV)

in which $R_{12}$,$R_{13}$,$R_{18}$ represent H or $CH_3$, $R_{14}$,$R_{15}$ represent H, $CH_3$, Cl or phenyl, $R_{16}$,$R_{17}$,$R_{19}$,$R_{20}$ represent H, $CH_3$, Cl, phenyl or $R_{16}$ together with $R_{17}$ or $R_{19}$ together with $R_{20}$ represent the remaining members of an optionally substituted aromatic or heteroaromatic ring and $R_5$,$R_8$,$X_1$ and $X_2$ are as defined above.

The following are suitable examples of formulae XX to XXII and their sensitization maxima in nm:

LS-XX-96: $X_1$, $X_2$, $X_3$=S, $X_4$=O, $R_1$, $R_2$, $R_3$, $R_4$, $R_7$ represent H, $R_5$, $R_6$ represent $CH_3$, $R_8$ represents $C_2H_5$; 595;

LS-XX-97: $X_1$, $X_2$, $X_3$=S, $X_4$=O, $R_1$, $R_2$, $R_3$, $R_4$, $R_6$, $R_7$ represent H, $R_5$ represents $CH_3$, $R_8$ represents $C_2H_5$; 590;

LS-XX-98: $X_1$, $X_2$, $X_3$=S, $X_4$=O, $R_1$, $R_2$, $R_3$, $R_4$, $R_7$ represent H, $R_5$, $R_8$ represents $C_2H_5$, $R_6$ represents $CH_3$; 600;

LS-XX-99: $X_1$, $X_2$, $X_3$=S, $X_4$=O, $R_1$, $R_2$, $R_3$, $R_4$, $R_6$, $R_7$ represent H, $R_5$ represents $(CH_2)_3SO_3H$, $R_8$ represents $C_2H_5$; 600;

LS-XX-100 $X_1$, $X_2$, $X_3$=S, $X_4$=O, $R_1$, $R_2$, $R_3$, $R_4$, $R_7$ represent H, $R_5$, $R_6$, $R_8$ represent $C_2H_5$; 600;

LS-XXI-101 $X_1$, $X_2$=S, $R_1$, $R_2$, $R_{10}$, $R_{11}$ represent phenyl, $R_5$, $R_7$, $R_8$ represent $C_2H_5$, $R_6$, $R_9$ represent H, $Y^{\ominus}$ represents $I^{\ominus}$, n=1; 582;

LS-XXI-102: $X_1$, $X_2$=S, $R_1$ together with $R_2$ and $R_{10}$ together with $R_{11}$ represent —CH=C($CH_3$)—C($CH_3$)=CH—, $R_5$, $R_8$ represent $(CH_2)_2COOH$, $R_6$, $R_7$, $R_9$ represent H, $Y^{\ominus}$ represents $I^{\ominus}$, n=1; 600;

LS-XXI-103: $X_1$, $X_2$=S, $R_1$ together with $R_2$ and $R_{10}$ together with $R_{11}$ represent —CH=C($CH_3$)13 C($CH_3$)=CH—, $R_5$ represents $CH_2COO(CH_2)_4SO_3^{\ominus}$, $R_8$ represents $CH_2COO(CH_2)_4SO_3H$, $R_6$, $R_7$, $R_9$ represent H, n=0; 600;

LS-XXI-104: $X_1$, $X_2$=S, $R_1$ together with $R_2$ represents

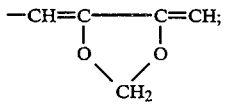

$R_{10}$ together with $R_{11}$ represents the remaining members of a 6-methyl thiazole, $R_5$, $R_7$ represent $C_2H_5$, $R_6$, $R_9$ represent H, $R_8$ represents $(CH_2)_3SO_3^{\ominus}$, n=0; 597;

LS-XXI-105: $X_1$, $X_2$=S, $R_1$ together with $R_2$ and $R_{10}$ together with $R_{11}$ represent

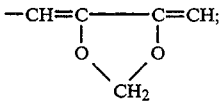

$R_5$, $R_7$ represents $C_2H_5$ $R_6$, $R_9$ represent H, $R_8$ represents $(CH_2)_3SO_3^{\ominus}$, n=0; 620;

LS-XXI-106: $X_1$, $X_2$=S, $R_1$ together with $R_2$ represents

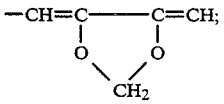

$R_{10}$ together with $R_{11}$ represents —CH=C($CH_3$)—C($CH_3$)=CH—, $R_5$ represents $(CH_2)_4SO_3^{\ominus}$, $R_6$, $R_9$ represent H, $R_7$, $R_8$ represent $C_2H_5$, n=0; 600;

LS-XXI-107: $X_1$, $X_2$=S, $R_1$ together with $R_2$ represents the remaining members of a 5-methyl thiazole, $R_{10}$ together with $R_{11}$ represents the remaining members of a 5-methoxythiazole, $R_5$ represents $C_2H_5$, $R_6$, $R_9$ represent H, $R_7$ represents $CH_2$—$CH_2$-phenyl, $R_8$ represents $(CH_2)_3SO_3^{\ominus}$, n=0; 593;

LS-XXI-108: $X_1$, $X_2$=S, $R_1$ together with $R_2$ and $R_{10}$ together with $R_{11}$ represent —CH=CH—CH=CH—, $R_5$, $R_8$ represent $C_2H_5$, $R_6$, $R_9$ represent H, $R_7$ represents $CH_3$, $Y^{\ominus}$ represents $Br^{\ominus}$, n=1; 618;

LS-XXI-109: $X_1$, $X_2$=S, $R_1$ together with $R_2$ and $R_{10}$ together with $R_{11}$ represent —CH=CH—CH=CH—, $R_5$, $R_8$ represent $C_2H_5$, $R_6$, $R_9$ represent $CH_3$, $R_7$ represents H, $Y^{\ominus}$ represents $I^{\ominus}$, n=1; 590;

LS-XXI-110: $X_1$, $X_2$=S, $R_1$ together with $R_2$ represents

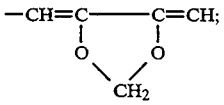

$R_{10}$together with $R_{11}$ represents the remaining members of a 5-hydroxybenzthiazole substituted at the OH group by

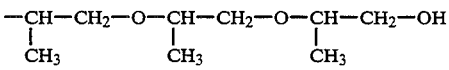

$R_5$ represents $(CH_2)_3SO_3^{\ominus}$, $R_7$, $R_8$ represents $CH_3$, $R_6$, $R_9$ represents H, n=0; 600;

LS-XXI-111: $X_1$, $X_2$=S, $R_1$ together with $R_2$ and $R_{10}$ together with $R_{11}$ represent —CH=CH—CH=CH—, $R_5$, $R_8$ represent $(CH_2)_2COOH$, $R_6$, $R_7$, $R_9$ represent H, $Y^{\ominus}$ represents $I^{\ominus}$, n=1; 600;

LS-XXI-112: $X_1$, $X_2$=S, $R_1$ together with $R_2$ and $R_{10}$ together with $R_{11}$ represent —CH=CH—CH=CH—, $R_5$ represents $C_2H_5$, $R_6$, $R_9$ represent H, $R_7$ represents $CH_3$, $R_8$ represents $(CH_2)_4SO_3^{\ominus}$, n=0; 620

LS-XXI-113: $X_1$=S, $X_2$=Se, $R_1$ together with $R_2$ represents —CH=CH—CH=CH—, $R_{10}$ together with $R_{11}$ represents the remaining members of a 5-methoxyselenoazole, $R_5$, $R_7$ represent $CH_3$, $R_6$, $R_9$ represent H, $R_8$ represents $C_2H_5$, $Y^{\ominus}$ represents $ClO_4^{\ominus}$, n=1; 590;

LS-XXI-114: $X_1$, $X_2$=S, $R_1$ together with $R_2$ and $R_{10}$ together with $R_{11}$ represent —CH=CH—CH=CH—, $R_5$, $R_8$ represent $C_2H_5$, $R_6$, $R_7$, $R_9$ represent H, $Y^{\ominus}$ represents $C_2H_5OSO_3^{\ominus}$, n=1; 585;

LS-XXI-115: $X_1$, $X_2$=S, $R_1$ together with $R_2$ and $R_{10}$ together with $R_{11}$ represent —CH=CH—CH=CH—, $R_5$, $R_8$ represent $(CH_2)_3COOH$, $R_6$, $R_7$, $R_9$ represent H, $Y^{\ominus}$ represents $I^{\ominus}$, n=1; 588;

LS-XXI-116: $X_1$, $X_2$=S, $R_1$ together with $R_2$ and $R_{10}$ together with $R_{11}$ represent —CH=CH—CH=CH—, $R_5$, $R_8$ represent $CH_3$, $R_6$, $R_9$ represent H, $R_7$ represents $C_2H_5$, $Y^{\ominus}$ represents $Cl^{\ominus}$, n=1; 605;

LS-XXI-117: $X_1$, $X_2$=S, $R_1$ together with $R_2$ represents —CH=CH—CH=CH—, $R_{10}$ together with $R_{11}$ represents

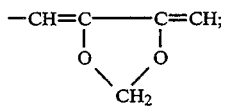

$R_5$ represents $(CH_2)_2SO_2(CH_2)_2SO_3^{\ominus}$, $R_6$, $R_9$ represent H, $R_7$, $R_5$ represents $C_2H_5$, n=0; 598;

LS-XXI-118: $X_1$, $X_2$=S, $R_1$ together with $R_2$ and $R_{10}$ together with $R_{11}$ represent —CH=CH—CH=CH—, $R_5$ represents $(CH_2)_2SO_2(CH_2)_2SO_3^{\ominus}$, $R_6$, $R_7$, $R_9$ represent H, $R_8$ represents $(CH_2)_2SO_2(CH_2)_2SO_3H$, n=0; 595;

LS-XXI-119: $X_1$, $X_2$=S, $R_1$ together with $R_2$ and $R_{10}$ together with $R_{11}$ represent the remaining members of a 5-methyl benzthiazole, $R_5$, $R_8$ represent $C_2H_5$, $R_6$, $R_7$, $R_9$ represent H, $Y^{\ominus}$ represents $I^{\ominus}$, n=1; 592;

LS-XXI-120 $X_1$, $X_2$=S, $R_1$ together with $R_2$ and $R_{10}$ together with $R_{11}$ represent —CH=CH—CH=CH—, $R_5$ denotes $C_2H_5$, $R_7$ denotes $CH_3$, $R_6$, $R_9$ represent H, $R_8$ represents $CH_2$—CH(OH)—$CH_2$—$SO_3^{\ominus}$, n=0; 580;

LS-XXI-121: $X_1$, $X_2$=S, $R_1$ together with $R_2$ and $R_{10}$ together with $R_{11}$ represent the remaining members of a 5-chlorobenzthiazole, $R_5$ represents $(CH_2)_3SO_3^{\ominus}$, $R_6$, $R_9$ represent H, $R_7$ represents $C_2H_5$, $R_8$ represents $(CH_2)_3SO_3H$, n=0; 650;

LS-XXI-122: $X_1$, $X_2$=S, $R_1$ together with $R_2$ represents

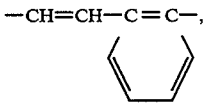

$R_{10}$ together with $R_{11}$ represents the remaining members of a 5-hydroxybenzthiazole substituted at the OH group by

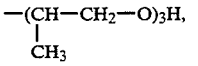

represents $(CH_2)_3SO_3^{\ominus}$, $R_6$, $R_9$ represent H, $R_7$, $R_8$ represent $CH_3$, n=0; 600;

LS-XXI-123: $X_1$, $X_2$=S, $R^1$ together with $R_2$ represents

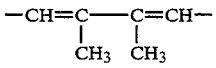

$R_{10}$ together with $R_{11}$ represents the remaining members of a 5-hydroxybenzthiazole substituted at the OH group by

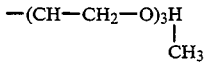

represents $(CH_2)_3SO_3^{\ominus}$, $R_6$, $R_9$ represent H, $R_8$ represents $CH_3$, $R_7$ represents $C_2H_5$, n=0; 640;

LS-XXI-124: $X_1$, $X_2$=S, $R_1$ together with $R_2$ and $R_{10}$ together with $R_{11}$ represent the remaining members of a 6-phenoxybenzthiazole, $R_5$, $R_8$ represent $CH_3$, $R_6$, $R_9$ represent H, $R_7$ represents $C_2H_5$, $Y^{\ominus}$ represents $ClO_4^{\ominus}$, n=1; 585;

LS-XXI-125: $X_1$=Se, $X_2$=S, $R_1$ together with $R_2$ represents

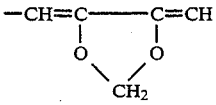

with $R_{11}$ represents the remaining members of a 5-hydroxybenzthiazole, $R_5$ represents $(CH_2)_3SO_3^{\ominus}$, $R_6$, $R_9$ represent H, $R_7$ represents $C_2H_5$, $R_8$ represents $CH_3$, n=0; 600;

LS-XXI-126: $X_1$,=O, $X_2$=Se, $R_1$ together with $R_2$ represents

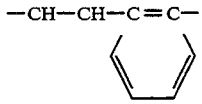

$R_{10}$ together with $R_{11}$ represents the remaining members of a 5-methyl-6-methoxybenzselenoazole, $R_5$ represents $(CH_2)_3SO_3^{\ominus}$, $R_6$, $R_9$ represent H, $R_7$, $R_8$ represent $C_2H_5$, n=0; 620;

LS-XXI-127: $X_1$,=O, $X_2$=S, $R_1$ together with $R_2$ represents

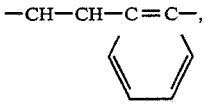

$R_{10}$ together with $R_{11}$ represents the remaining members of a 5-chlorobenzthiazole, $R_5$ represents $(CH_2)_3SO_3^{\ominus}$, $R_9$ represent H, $R_7$ represents $C_2H_5$, $R_5$ represents $(CH_2)_3SO_3H$, n=0; 610;

LS-XXI-128: $X_1$,=O, $X_2$=S, $R_1$ together with $R_9$ represents

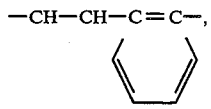

$R_{10}$ together with $R_{11}$ represents the remaining members of a 5-chlorobenzthiazole, $R_5$ represents $(CH_2)_3SO_3\ominus$, $R_6$, $R_9$ represent H, $R_7$ represents $C_2H_5$, $R_5$ represents $(CH_2)_4SO_3H$, n=0; 610;

LS-XXI-129: $X_1$, $X_2$=Se, $R_1$ together with $R_2$ and $R_{10}$ together with $R_{11}$ represent —CH=CH—CH=CH—, $R_5$, $R_8$ represent $C_2H_5$, $R_6$, $R_9$ represent H, $R_7$ represents $CH_3$, $Y\ominus$ represents $ClO_4\ominus$, n=1; 635;

LS-XXI-130: $X_1$, $X_2$=N—$C_2H_5$, $R_1$ together with $R_2$ represents

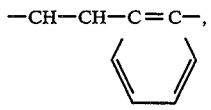

$R_{10}$ together with $R_{11}$ represents

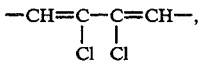

$R_5$ represents $(CH_2)_3SO_3\ominus$, $R_6$, $R_7$, $R_9$ represent H, $R_8$ represents $(CH_2)_2CH(CH_3)SO_3H$, n=0; 620;

LS-XXI-131: $X_1$=O, $X_2$=Se, $R_1$ together with $R_2$ represents the remaining members of a 5-methyl benzoxazole, $R_{10}$ together with $R_{11}$ represents the remaining members of a 5-methyl-6-methoxybenzselenoazole, $R_5$ represents $(CH_2)_3SO_3\ominus$, $R_6$, $R_9$ represent H, $R_7$, $R_8$ represent $C_2H_5$, n=0; 620;

LS-XXI-132: $X_1$=S, $X_2$=Se, $R_1$ together with $R_2$ and $R_{10}$ together with $R_{11}$ represent —CH=CH—CH=CH—, $R_5$ represents $(CH_2)_2SO_2(CH_2)_2SO_3\ominus$, $R_6$, $R_9$ represent H, $R_7$ represents $CH_3$, $R_8$ represents $C_2H_5$, n=0; 590;

LS-XXII-133: $X_2$=$C(CH_3)_2$, $R_1$ together with $R_2$ and $R_{10}$ together with $R_{11}$ represent —CH=CH—CH=CH—, $R_5$ represents $(CH_2)_4$—$SO_3\ominus$, $R_6$, $R_7$, $R_9$ represent H, $R_8$ represents $CH_3$, n=0; 580.

Sensitizers need not be used where the natural sensitivity of the silver halide is sufficient for a certain spectral region, for example the blue sensitivity of silver bromide iodides.

Color couplers for producing the cyan dye image are generally couplers of the phenol or α-naphthol type. Color couplers for producing the magenta dye image are generally couplers of the 5-pyrazolone, indazolone or pyrazoloazole type.

Color couplers for producing the yellow dye image are generally couplers containing an open-chain ketomethylene group, more especially couplers of the α-acylacetamide type, of which suitable examples are α-benzoyl acetanilide couplers and α-pivaloyl acetanilide couplers.

The color couplers may be 4-equivalent couplers and also 2-equivalent couplers. 2-Equivalent couplers are derived from 4-equivalent couplers in that they contain in the coupling position a substituent which is eliminated during the coupling reaction.

The couplers normally contain a ballast group to prevent diffusion within the material, i.e. both within a layer and from layer to layer. Instead of couplers containing a ballast group, it is also possible to use high molecular weight couplers.

Suitable color couplers and literature references in which they are described can be found in Research Disclosure 17 643 (1978), Chapter VII.

High molecular weight color couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4,080,211. The high molecular weight color couplers are generally produced by polymerization of ethylenically unsaturated monomeric color couplers. However, they may also be obtained by polyaddition or polycondensation.

The couplers or other compounds may be incorporated in silver halide emulsion layers by initially preparing a solution, a dispersion or an emulsion of the particular compound and then adding it to the casting solution for the particular layer. The choice of a suitable solvent or dispersant depends upon the particular solubility of the compound.

Methods for introducing compounds substantially insoluble in water by grinding processes are described, for example, in DE-A-26 09 741 and DE-A-26 09 742.

Hydrophobic compounds may also be introduced into the casting solution using high-boiling solvents, so-called oil formers. Corresponding methods are described, for example in U.S. Pat. Nos. 2,322,027, 2,801,170, 2,801,171 and EP-A-0 043 037.

Instead of using high-boiling solvents, it is also possible to use oligomers or polymers, so-called polymeric oil formers.

The compounds may also be introduced into the casting solution in the form of charged latices, cf. for example DE-A-25 41 230, DE-A-25 41 274, DE-A-28 35 856, EP-A-0 014 921, EP-A-0 069 671, EP-A-0 130 115, U.S. Pat. No. 4,291,113.

Anionic water-soluble compounds (for example dyes) may also be incorporated in non-diffusing form with the aid of cationic polymers, so-called mordant polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethyl hexyl phthalate, decyl phthalate, triphenyl phosphate, tricresyl phosphate, 2-ethyl hexyl diphenyl phosphate, tricyclohexyl phosphate, tri-2-ethyl hexyl phosphate, tridecyl phosphate, tributoxyethyl phosphate, trichloropropyl phosphate, di-2-ethyl hexyl phenyl phosphate, 2-ethyl hexyl benzoate, dodecyl benzoate, 2-ethyl hexyl-p-hydroxybenzoate, diethyl dodecaneamide, N-tetradecyl pyrrolidone, isostearyl alcohol, 2,4-di-tert.amyl phenol, trioctyl citrate, N,N-dibutyl-2-butoxy-5-tert.octyl aniline, paraffin, dodecylbenzene and diisopropyl naphthalene.

The photographic material may also contain UV absorbers, whiteners, spacers, filter dyes, formalin scavengers, light stabilizers, antioxidants, $D_{min}$ dyes, additives for improving dye, coupler and white stabilization and for reducing color fogging, plasticizers (latices), biocides and other additives.

UV-absorbing compounds are intended on the one hand to protect the image dyes against fading under the effect of UV-rich daylight and, on the other hand, as filter dyes to absorb the UV component of daylight on exposure and thus to improve the color reproduction of a film. Compounds of different structure are normally used for the two functions. Examples are aryl-substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic acid ester compounds (U.S. Pat. Nos. 3,705,805 and 3,707,375), butadiene compounds (U.S. Pat. No. 4,045,229) or benzoxazole compounds (U.S. Pat. No. 3,700,455).

It is also possible to use UV-absorbing couplers (such as cyan couplers of the $\alpha$-naphthol type) and UV-absorbing polymers. These UV absorbers may be fixed in a special layer by mordanting.

Filter dyes suitable for visible light include oxonol dyes, hemioxonol dyes, styryl dyes, merocyanine dyes, cyanine dyes and azo dyes. Of these dyes, oxonol dyes, hemioxonol dyes and merocyanine dyes may be used with particular advantage.

Suitable whiteners are described, for example, in Research Disclosure 17 643 (December 1978), Chapter V, in U.S. Pat. Nos. 2,632,701 and 3,269,840 and in GB-A-852,075 and 1,319,763.

Certain binder layers, particularly the layer furthest from the support, but occasionally interlayers as well, particularly where they are the layer furthest from the support during production, may contain inorganic or organic, photographically inert particles, for example as matting agents or as spacers (DE-A-33 31 542, DE-A-34 24 893, Research Disclosure 17 643 (December 1978), Chapter XVI).

The mean particle diameter of the spacers is particularly in the range from 0.2 to 10 $\mu$m. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

Additives for improving dye, coupler and white stability and for reducing color fogging (Research Disclosure 17 643 (December 1978), Chapter VII) may belong to the following classes of chemical compounds: hydroquinones, 6-hydroxychromanes, 5-hydroxycoumaranes, spirochromanes, spiroindanes, p-alkoxyphenols, sterically hindered phenols, gallic acid derivatives, methylenedioxybenzenes, aminophenols, sterically hindered amines, derivatives containing esterified or etherified phenolic hydroxyl groups, metal complexes.

Compounds containing both a sterically hindered amine partial structure and also a sterically hindered phenol partial structure in one and the same molecule (U.S. Pat. No. 4,268,593) are particularly effective for preventing the impairment (deterioration or degradation) of yellow dye images as a result of the generation of heat, moisture and light. Spiroindanes (JP-A-159 644/81) and chromanes substituted by hydroquinone diethers or monoethers (JP-A-89 83 5/80) are particularly effective for preventing the impairment (deterioration or degradation) of magenta-red dye images, particularly their impairment (deterioration or degradation) as a result of the effect of light.

The layers of the photographic material may be hardened with the usual hardeners. Suitable hardeners are, for example, formaldehyde, glutaraldehyde and similar aldehyde compounds, diacetyl, cyclopentadione and similar ketone compounds, bis-(2-chloroethylurea), 2-hydroxy-4,6-dichloro-1,3,5-triazine and other compounds containing reactive halogen (U.S. Pat. Nos. 3,288,775, 2,732,303, GB-A-974,723 and GB-A-1,167,207), divinylsulfone compounds, 5-acetyl-1,3-diacryloyl hexahydro-1,3,5-triazine and other compounds containing a reactive olefin bond (U.S. Pat. Nos. 3,635,718, 3,232,763 and GB-A-994,869); N-hydroxymethyl phthalimide and other N-methylol compounds (U.S. Pat. Nos. 2,732,316 and 2,586,168); isocyanates (U.S. Pat. No. 3,103,437); aziridine compounds (U.S. Pat. Nos. 3,017,280 and 2,983,611 ); acid derivatives (U.S. Pat. Nos. 2,725,294 and 2,725,295); compounds of the carbodiimide type (U.S. Pat. No. 3,100,704); carbamoyl pyridinium salts (DE-A-22 25 230 and DE-A-24 39 551); carbamoyloxy pyridinium compounds (DE-A-24 08 814); compounds containing a phosphorus-halogen bond (JP-A-113 929/83); N-carbonyloximide compounds (JP-A-43353/81); N-sulfonyloximido compounds (U.S. Pat. No. 4,111,926), dihydroquinoline compounds (U.S. Pat. No. 4,013,468 ), 2-sulfonyloxy pyridinium salts (JP-A-110 762/81), formamidinium salts (EP-A-0 162 308), compounds containing two or more N-acyloximino groups (U.S. Pat. No. 4,052,373), epoxy compounds (U.S. Pat. No. 3,091,537), compounds of the isoxazole type (U.S. Pat. Nos. 3,321,313 and 3,543,292); halocarboxyaldehydes, such as mucochloric acid; dioxane derivatives, such as dihydroxydioxane and dichlorodioxane; and inorganic hardeners, such as chrome alum and zirconium sulfate.

Hardening may be carried out in known manner by adding the hardener to the casting solution for the layer to be hardened or by overcoating the layer to be hardened with a layer containing a diffusible hardener. Among the classes mentioned, there are slow-acting and fast-acting hardeners and also so-called instant hardeners which are particularly advantageous. Instant hardeners are understood to be compounds which crosslink suitable binders in such a way that, immediately after casting but at the latest 24 hours and, preferably 8 hours after casting, hardening has advanced to such an extent that there is no further change in the sensitometry and swelling of the layer combination as a result of the crosslinking reaction. By swelling is meant the difference between the wet layer thickness and dry layer thickness during aqueous processing of the film (Photogr. Sci. Eng. 8 (1964), 275; Photogr. Sci. Eng. (1972), 449).

These hardeners which react very quickly with gelatine are, for example, carbamoyl pyridinium salts which are capable of reacting with free carboxyl groups of the gelatine so that these groups react with free amino groups of the gelatine with formation of peptide bonds and crosslinking of the gelatine.

There are diffusible hardeners which have the same hardening effect on all the layers of a layer combination. However, there are also non-diffusing, low molecular weight and high molecular weight hardeners of which the effect is confined to certain layers. With hardeners of this type, individual layers, for example the protective layer, may be crosslinked particularly highly. This is important where the silver halide layer is minimally hardened to increase the covering power of the silver and the mechanical properties have to be improved through the protective layer (EP-A 0 114 699).

The color photographic materials according to the invention are normally processed by development, bleaching, fixing and washing or stabilization without subsequent washing; bleaching and fixing may be combined into a single process step. Suitable color developer compounds are any developer compounds which are capable of reacting in the form of their oxidation product with color couplers to form azomethine or indophenol dyes. Suitable color developer compounds are aromatic compounds containing at least one primary amino group of the p-phenylenediamine type, for example N,N-dialkyl-p-phenylenediamines, such as N,N-diethyl-p-phenylenediamine, 1-(N-ethyl-N-methanesulfonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Other useful color developers are described, for example, in J. Amer. Chem. Soc. 73, 3106 (1951) and in G. Haist, Modern Photographic Processing, 1979, John Wiley and Sons, New York, pages 545 et seq.

Color development may be followed by an acidic stop bath or by washing.

The material is normally bleached and fixed immediately after color development. Suitable bleaches are, for example, Fe(III) salts and Fe(III) complex salts, such as ferricyanides, dichromates, water-soluble cobalt complexes. Particularly preferred bleaches are iron(III) complexes of aminopolycarboxylic acids, more especially for example ethylenediamine tetraacetic acid, propylenediamine tetraacetic acid, diethylenetriamine pentaacetic acid, nitrilotriacetic acid, alanine diacetic acid, iminodiacetic acid, N-hydroxyethyl ethylene diamine triacetic acid, alkyliminodicarboxylic acids, and of corresponding phosphonic acids. Other suitable bleaches are persulfates and peroxides, for example hydrogen peroxide.

The bleaching/fixing bath or fixing bath is generally followed by washing which is carried out in countercurrent or consists of several tanks with their own water supply.

Favorable results can be obtained where a following finishing bath containing little or no formaldehyde is used.

However, washing may be completely replaced by a stabilizing bath which is normally operated in countercurrent. Where formaldehyde is added, this stabilizing bath also performs the function of a finishing bath.

The color photographic material according to the invention may also be subjected to reversal development. In this process, color development is preceded by a first development with a developer which does not form a dye with the couplers and by a diffuse second exposure or chemical fogging. In this case, the silver halide emulsion for the coupler-free layer adjacent at least one dye-producing silver halide emulsion layer is best an emulsion of which the sensitivity is greater, particularly 0.6 to 2.5 log H units greater, than the sensitivity of the dye-producing layer.

However, the material according to the invention is preferably a color negative material, more particularly a color negative paper, or a color display material.

EXAMPLES

A color photographic recording material suitable for rapid processing was prepared by applying the following layers in the order listed to a paper coated on both sides with polyethylene. The quantities shown are all based on 1 $m^2$. For the silver halide applied, the corresponding quantities of $AgNO_3$ are shown.

Example 1

Layer combination 1
- 1st Layer (substrate layer)
- 0.2 g gelatine
- 2nd Layer (blue-sensitive layer)
- blue-sensitive silver halide emulsion (99.5 mol-% chloride, 0.5 mol-% bromide, mean particle diameter 0.78 μm) of 0.50 g $AgNO_3$, sensitization maximum 480 nm, containing
  - 1.38 g gelatine
  - 0.60 g yellow coupler Y-1
  - 0.48 g tricresyl phosphate (TCP)
- 3rd Layer (interlayer)
- 1.18 g gelatine
- 0.08 g 2,5-dioctyl hydroquinone
- 0.08 g dibutyl phthalate (DBP)
- 4th Layer (green-sensitive layer)
- green-sensitized silver halide emulsion (99.5 mol-% chloride, 0.5 mol-% bromide, mean particle diameter 0.37 μm) of 0.40 g $AgNO_3$, sensitization maximum 550 nm, containing
  - 1.02 g gelatine
  - 0.37 g magenta coupler M-1
  - 0.40 g DBP
- 5th Layer (interlayer)
- 1.20 g gelatine
- 0.66 g UV absorber corresponding to the following formula

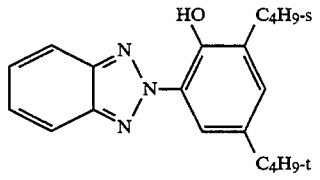

- 0.052 g 2,5-dioctyl hydroquinone
- 0.36 g TCP
- 6th Layer (red-sensitive layer)
- red-sensitized silver halide emulsion (99.5 mol-% chloride, 0.5 mol-% bromide, mean particle diameter 0.35 μm) of 0.28 g $AgNO_3$, sensitization maximum 708 nm, containing
  - 0.84 g gelatine
  - 0.39 g cyan coupler C-1
  - 0.39 g TCP
- 7th Layer (UV-absorbing layer)
- 0.65 g gelatine
- 0.21 g UV absorber as in 5th layer
- 0.11 g TCP
- 8th Layer (protective layer)
- 0.65 g gelatine
- 0.39 g hardener corresponding to the following formula

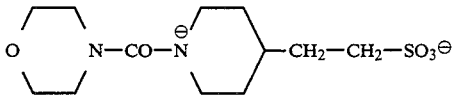

Example 2 (Comparison)

A color photographic recording material was prepared in the same way as described in Example 1 except that the red-sensitive emulsion in layer 6 was additionally green-sensitized with GS 1 (50 μmol/mol Ag).

Example 3 (Comparison)

A color photographic recording material was prepared in the same way as described in Example 1 except that layer 6 contained a red-sensitized silver halide emulsion (99.5 mol-% chloride, 0.5 mol-% bromide, mean particle diameter 0.50 μm) of 0.28 g $AgNO_3$ which had been additionally sensitized with 50 μmol BS 1/mol Ag.

Example 4 (Invention)

A color photographic recording material was prepared in the same way as described in Example 1 except that layer 5 contained an additional silver halide emulsion (99.5 mol-% chloride, 0.5 mol-% bromide, mean particle diameter 0.50 μm) of 0.20 g $AgNO_3$ which had been gap-sensitized (λ=500 nm) with 20 μmol LS-IV-53/mol Ag.

Example 5 (Invention)

A color photographic recording material was prepared in the same way as in Example 1 except that layer 3 contained an additional silver halide emulsion (99.5 mol-% chloride, 0.5 mol-% bromide, mean particle diameter 0.50 μm) of 0.20 g $AgNO_3$ which had been gap-sensitized (λ=600 nm) with 100 μmol LS-XXI-106/mol Ag.

Example 6 (Invention)

A color photographic recording material was prepared in the same way as described in Example 1, except that layer 5 contained an additional silver halide emulsion (99.5 mol-% chloride, 0.5 mol-% bromide, mean particle diameter 0.50 μm) of 0.20 g $AgNO_3$ which had been gap-sensitized (λ=500 nm) with 20 μmol LS-IV-53/mol Ag and layer 3 contained an additional silver halide emulsion (99.5 mol-% chloride, 0.5 mol-% bromide, mean particle diameter 0.50 μm) of 0.20 g $AgNO_3$ which had been gap-sensitized (λ=600 nm) with 100 μmol LS-XXI-106/mol Ag.

The materials are subjected to exposures a), b), c) or d) below and processed by the described process.

Exposure a) through a step wedge with a filter which transmits green light,
b) through a step wedge with a filter which transmits blue light,
c) through a step wedge with a filter which transmits both blue and green light and, at the same time, with a correcting filter (magenta and yellow) so that, after processing, a clean red is formed on the print material throughout the entire density range.
d) through a step wedge with a filter which transmits both red and green light and, at the same time, with a correcting filter (magenta) so that a clean blue is formed on the print material throughout the entire density range.

Measurements are carried out to determine a) the number of visible steps,
b) the percentage cyan (cy) content is determined at density 2.0 magenta (mg) or yellow (y) (=secondary density, SD) $SD_{cy}=[D_{cy}$ at $D_{mg}=2.0/D_{mg}=2.0].100$ Results:

| Material | Exposure | Number of visible steps | $SD_{cy}$ [%] |
|---|---|---|---|
| 1 | a | 15 | 10 Comparison |
| | b | 15 | 3 Comparison |
| | c | 15 | — Comparison |
| | d | 15 | — Comparison |
| 2 | a | 17 | 13 Comparison |
| | c | 17 | — Comparison |
| 3 | b | 16 | 7 Comparison |
| | c | 18 | — Comparison |
| 4 | a | 17 | 10 Invention |
| | c | 20 | — Invention |
| 5 | d | 18 | — Invention |
| | b | 17 | 4 Invention |
| 6 | a | 17 | 10 Invention |
| | b | 17 | 4 Invention |
| | c | 20 | — Invention |
| | d | 18 | — Invention |

The Examples clearly demonstrate that the invention provides for better detail reproduction at high red densities (exposure c) and high blue densities (expose d) without the otherwise simultaneous desaturation of mg (exposure a) or y (exposure b) at densities D≦2.0, as in material 2 or 3.

Y-1

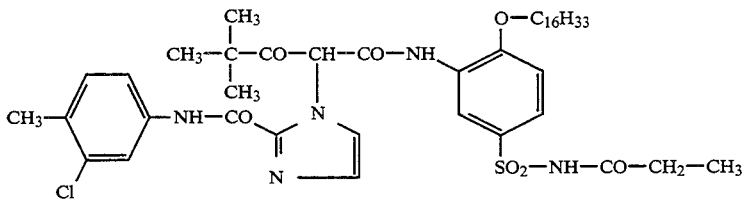

M-1

-continued

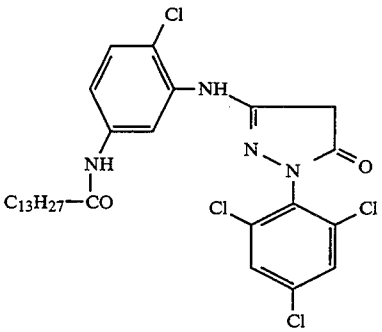

C-1

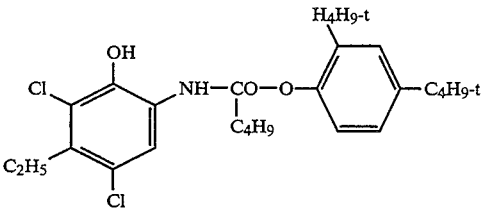

BS-1

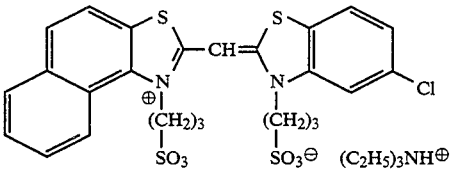

Sensitization maximum: 480 nm

GS-1

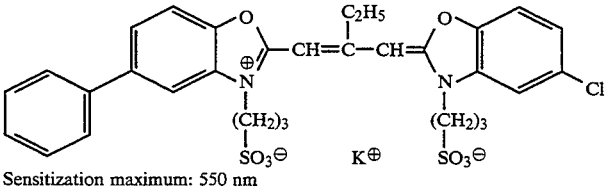

Sensitization maximum: 550 nm

RS-1

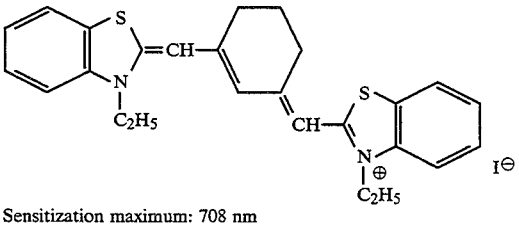

Sensitization maximum: 708 nm a) Color developer - 45 s - 35° C.

| | |
|---|---|
| Triethanolamine | 9.0 g/l |
| N,N-diethyl hydroxyamine | 4.0 g/l |
| Diethylene glycol | 0.05 g/l |
| 3-Methyl-4-amino-N-ethyl-N-methane sulfonamidoethyl aniline sulfate | 5.0 g/l |
| Potassium sulfite | 0.2 g/l |
| Triethylene glycol | 0.05 g/l |
| Potassium carbonate | 22 g/l |
| Potassium hydroxide | 0.4 g/l |
| Ethylenediamine tetraacetic acid disodium salt | 2.2 g/l |
| Potassium chloride | 2.5 g/l |
| 1,2-Dihydroxybenzene-3,4,6-trisulfonic acid trisodium salt | 0.3 g/l |
| Make up with water to 1,000 ml; pH 10.0 | |

b) Bleaching/fixing bath - 45 s - 35° C.

| | |
|---|---|
| Ammonia thiosulfate | 75 g/l |

-continued

| | |
|---|---|
| Sodium hydrogen sulfite | 13.5 g/l |
| Ammonium acetate | 2.0 g/l |
| Ethylenediamine tetraacetic acid (iron ammonium salt) | 57 g/l |
| Ammonia 25% by weight | 9.5 g/l |
| Acetic acid | 9.0 g/l |
| Make up with water to 1,000 ml; pH 5.5 | |
| c) Washing - 2 mins. - 33° C. | |
| d) Drying | |

We claim:

1. A color photographic material comprising on a support, at least one red sensitive layer containing a cyan coupler and a red sensitizer, at least one green sensitive layer containing a magenta coupler and a green sensitizer and at least one blue sensitive layer containing a yellow coupler and a blue sensitizer characterized in that a silver halide emulsion is provided in a coupler-free layer sensitized with another spectral sensitizer (a gap sensitizer) of which the sensitization maximum lies between the sensitization maxima of the red- and green-sensitive layers or the green- and blue-sensitive layers.

2. A color photographic silver halide material as claimed in claim 1, characterized in that the sensitization maximum of the gap sensitizer is at least 15 nm from the absorption maxima of the green and blue sensitizers and at least 30 nm from the absorption maximum of the red sensitizer.

3. A color photographic silver halide material as claimed in claim 1, wherein the gap sensitizer corresponds to one of formulae I to XI, XXVI and XXVII:

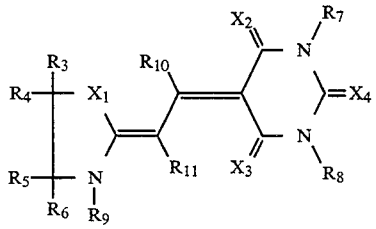
(I)

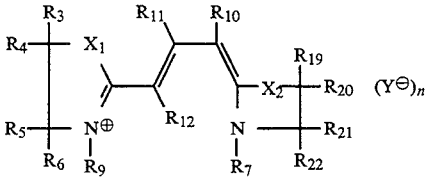
(II)

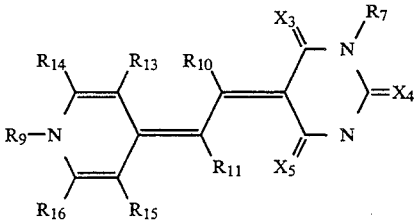
(III)

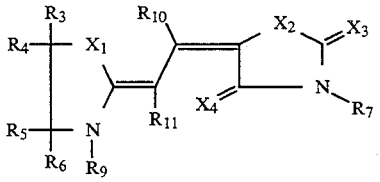
(IV)

-continued

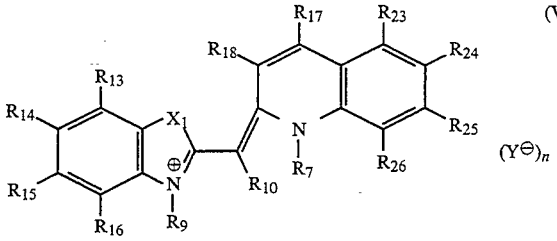
(V)

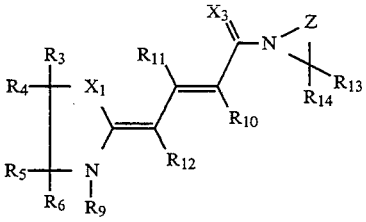
(VI)

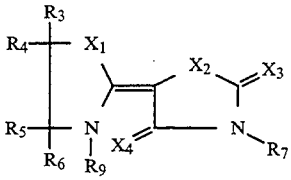
(VII)

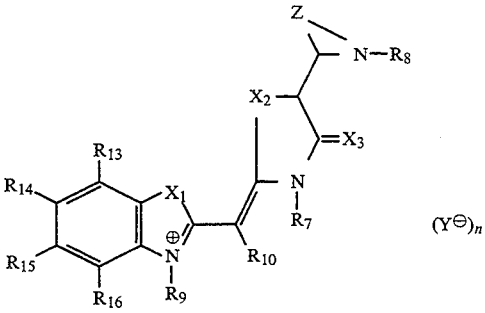
(VIII)

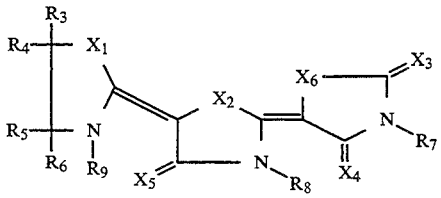
(IX)

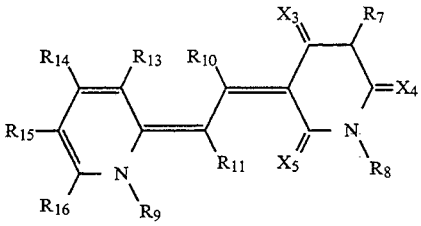
(X)

-continued (XI)

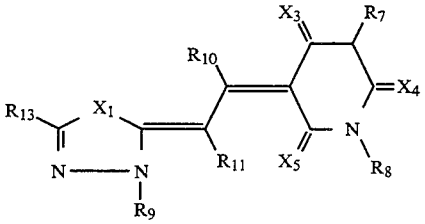

(XXVI)

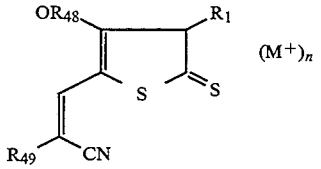

(XXVII)

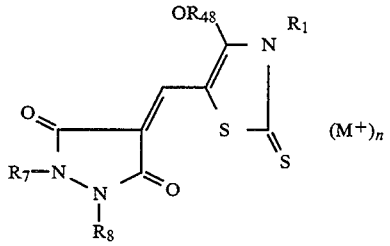

in which $X_1$–$X_6$ are the same or different and represent O, $NR_1$, S, Se, Te, $P(R_1)$, $P(R_1)_3$, $CH_2$, $CHR_2$ or $C(R_2)_2$, $R_1$ represents alkyl, sulfoalkyl, carboxyalkyl or aryl, $R_2$ represents aryl, alkyl, or CN $R_3$, $R_4$, $R_5$ $R_6$, $R_{19}$, $R_{20}$, $R_{21}$ and $R_{22}$ are the same or different and represent hydrogen, halogen, alkoxy, aryloxy, cyano, hydroxy, sulfo, carboxy, alkoxycarbonyl, aryloxycarbonyl, acylaminosulfonyl, aminosulfonyl, alkylaminosulfonyl, dialkylaminosulfonyl, arylaminosulfonyl, diarylaminosulfonyl, aryl, arylmercapto, alkylmercapto or alkyl or $R_3$ and $R_6$ or $R_{19}$ and $R_{22}$ together form a $\pi$-bond $R_4$ and $R_5$ or $R_{20}$ and $R_{21}$ together form a 3 to 12-membered ring which may contain heteroatoms and multiple bonds, $R_7$, $R_8$ and $R_9$ are the same or different and represent alkyl, sulfoalkyl, carboxyalkyl or aryl, $R_{10}$, $R_{11}$ and $R_{12}$ are the same or different and represent hydrogen, halogen, cyano, aryl, aryloxy, arylmercapto, alkyl, alkoxy or alkylmercapto, $R_{13}$, $R_{14}$, $R_{15}$, $R_{16}$, $R_{17}$, $R_{18}$, $R_{23}$, $R_{24}$, $R_{25}$ and $R_{26}$ are the same or different and represent hydrogen, halogen, alkoxy, cyano, hydroxy, sulfo, carboxy, alkoxycarbonyl, aryloxycarbonyl, acylaminosulfonyl, aminosulfonyl, alkylaminosulfonyl, arylaminosulfonyl, diarylaminosulfonyl, aryl, aryloxy, arylmercapto, alkyl or alkylmercapto, $R_{48}$ represents hydrogen, alkyl, sulfoalkyl, carboxyalkyl, acyl or a negative charge, $R_{49}$ represents a cation, Z represents the remaining members of a 3- to 12-membered ring which may contain heteroatoms and double bonds, $M^{\oplus}$ denotes a cation $Y^{\ominus}$ is an anion and n denotes 0 or 1.

4. A color photographic silver halide material as claimed in claim 1, wherein the gap sensitizer corresponds to one of formulae XII to XIX (XII)

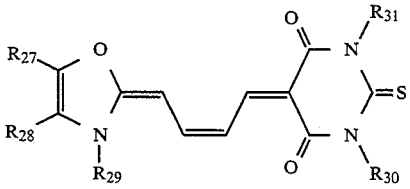

(XIII)

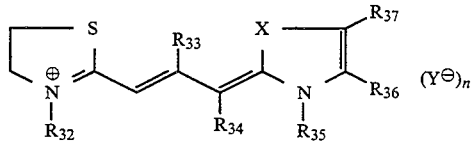

(XIV)

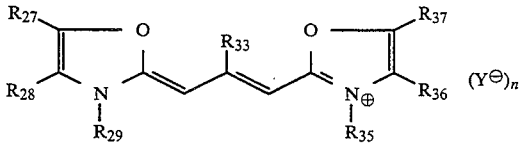

(XV)

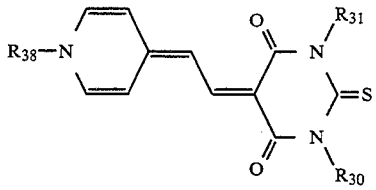

(XVI)

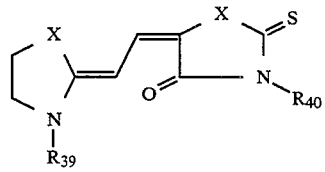

(XVII)

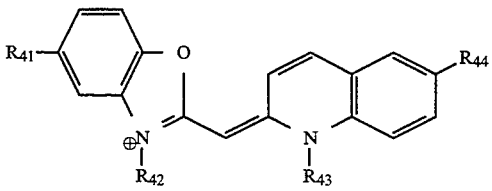

(XVIII)

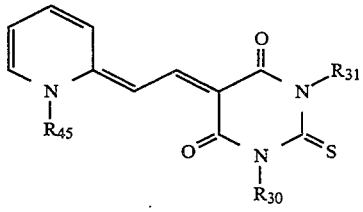

(XIX)

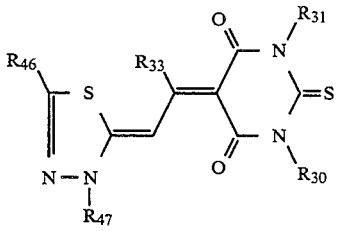

in which

X denotes O, S, Se or $NR_1$;

$R_1$ represents alkyl, sulfoalkyl, carboxyalkyl or aryl;

$R_{27}$ and $R_{28}$ are the same or different and denote H, $CH_3$, phenyl, 2-furyl, Cl, methoxycarbonyl or ethoxycarbonyl;

$R_{29}$, $R_{32}$, $R_{35}$, $R_{38}$, $R_{39}$, $R_{40}$, $R_{42}$, $R_{43}$, $R_{45}$ and $R_{47}$ are the same or different and denote methyl, ethyl, sulfoalkyl or carboxyalkyl;

$R_{30}$ and $R_{31}$ are the same or different and denote hydrogen methyl, ethyl, sulfoalkyl or carboxyalkyl;

$R_{33}$ denotes hydrogen, methyl or ethyl;

$R_{34}$ denotes H or CN;

$R_{36}$ and $R_{37}$ are the same or different and denote H, $CH_3$, $C_2H_5$, phenyl, ethoxy, morpholinocarbonyl, 1-hydroxyisopropyl, Cl, methoxycarbonyl or ethoxycarbonyl;

$R_{41}$ denotes H, Cl, $CH_3$, OH, $OCH_3$ or phenyl;

$R_{44}$ denotes H or $OCH_3$;

$H_{46}$ denotes H, $CH_3$, $SCH_3$, Cl or phenyl.

5. A color photographic silver halide material as claimed in claim 1, wherein the gap sensitizer corresponds to one of formulae XX to XXII:

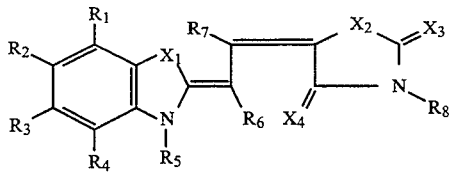
(XX)

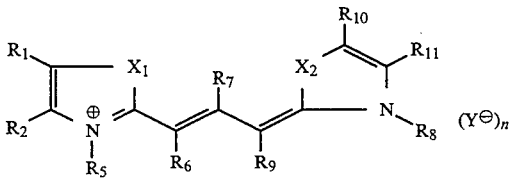
(XXI)

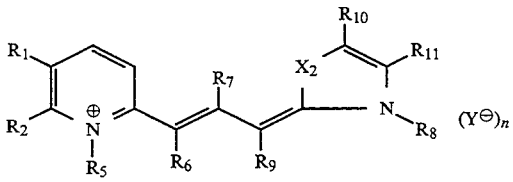
(XXII)

in which $R_1$, $R_2$, $R_3$, $R_4$, $R_{10}$ and $R_{11}$ are the same or different and represent hydrogen, halogen, alkoxy, arlyoxy, cyano, hydroxy, sulfo, carboxy, alkoxycarbonyl, aryloxycarbonyl, acyl aminosulfonyl, diaryl aminosulfonyl, aryl, arylmercapto, alkylmercapto or alkyl or $R_1$ and $R_2$ together or $R_2$ and $R_3$ together or $R_3$ and $R_4$ together or $R_{10}$ and $R_{11}$ together form an aromatic or heteroaromatic 3- to 12-membered ring, $R_5$ and $R_8$ are the same or different and represent aryl, alkyl, sulfoalkyl or carboxyalkyl, $X_1$, $X_2$, $X_3$ and $X_4$ are the same or different and represent O, NR, S, Se, Te, PR, $PR_3$, $CH_2$, CH, alkyl, $C(alkyl)_2$, CH aryl or $C(aryl)_2$, $Y^{\ominus}$ is an anion and n represents 0 or 1.

6. A color photographic silver halide material as claimed in claim 5, characterized in that the gap sensitizer corresponds to one of formulae XXIII to XXV

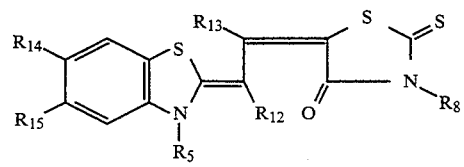
(XXIII)

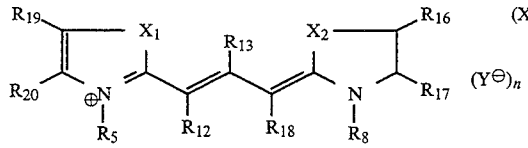
(XXIV)

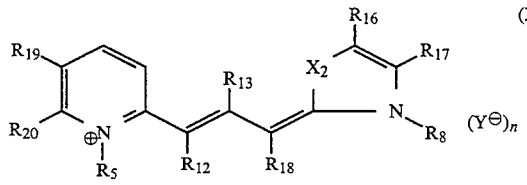
(XXV)

in which $R_{12}$, $R_{13}$ and $R_{18}$ are the same or different and represent H or $CH_3$, $R_{14}$ and $R_{15}$ are the same or different and represent H, $CH_3$, Cl or phenyl, $R_{16}$, $R_{17}$, $R_{19}$ and $R_{20}$ are the same or different and represent H, $CH_3$, Cl or phenyl or $R_{16}$ together with $R_{17}$ or $R_{19}$ together with $R_{20}$ represent the remaining members of an aromatic or heteroaromatic ring.

7. The color photographic silver halide material as claimed in claim 3, wherein $R_2$ is phenyl or an alkyl containing 1 to 5 carbon atoms.

8. The color photographic silver halide material as claimed in claim 5, wherein $R_1$ and $R_2$ together or $R_2$ and $R_3$ together or $R_3$ and $R_4$ together or $R_{10}$ and $R_{11}$ together form a fused benzo or naphtho ring.

9. The color photographic silver halide material as claimed in claim 1, wherein the gap sensitizer is used in a quantity from 0.01 to 3 $\mu mol/m^2$.

10. The color photographic silver halide material as claimed in claim 1, which further comprises at least one sensitized inner layer and wherein there is at least one blue-sensitive silver halide emulsion layer containing at least one yellow coupler; at least one green-sensitive silver halide emulsion layer containing at least one magenta coupler; at least one red-sensitive silver halide emulsion layer containing at least one cyan coupler; and at least one protective layer in that order on a support.

11. The color photographic silver halide material as claimed in claim 10, wherein the sensitized inner layer is between the magenta-coupler containing silver halide emulsion layer and the cyan coupling silver halide emulsion layer contains a silver halide emulsion sensitized for the 495 to 530 nm range.

12. The color photographic silver halide material as claimed in claim 10, wherein the silver halides of the all the photosensitive layers, including the inner layers, contain at least 80 mol % chloride, 0 to 5 mol % bromide and 0 to 1 mol % iodide.

13. The color photographic silver halide material as claimed in claim 11, wherein the silver halides of all the photosensitive layers, including the inner layers, contain 95 to 100 mol % chloride, 0 to 5 mol % bromide and 0 to 1 mol % iodide.

14. The color photographic silver halide material as claimed in claim 1, wherein the silver halide is precipitated out in the presence of a binder wherein said binder is gelatin or it may be partially or completely replaced by other synthetic, semi-synthetic or natural occurring polymers.

15. The color photographic silver halide material as claimed in claim 14, wherein said binder is selected from the group consisting of polyvinyl alcohol, poly-N-vinyl pyrrolidone, polyacrylamide, polyacrylic acid, albumin, casein, cellulose, chitine, chitosane, sugar, starch and alginate.

16. The color photographic silver halide material as claimed in claim 1, further comprising additional compounds for preventing fogging or for stabilizing the photographic function during the production, storage or photographic processing.

17. The color photographic silver halide material as claimed in claim 1, wherein stabilizers are added to the silver halide emulsions before, during or after chemical ripening of the silver halide grains comprising the said silver halide emulsion.

18. The color photographic silver halide material as claimed in claim 17, wherein the chemical ripening is by the reaction of gold compounds or compounds of divalent sulfur.

19. The color photographic silver halide material as claimed in claim 1, wherein the red sensitizer is selected from the group consisting of dicarbocyanines containing naphthothiazole end groups, dicarbocyanines containing benzothiozole end groups, which both may be substituted in the 5 and/or 6 position by halogen, methyl or methoxy and 9,11-neopentylene-thiadicarbocyanines carrying alkyl or sulphoalkyl substitutents on the nitrogen; and the green sensitizers are 9-ethyloxacarbocyanines which are substituted in the 5 position by chlorine or phenyl and carry an alkyl or sulphoalkyl groups on the nitrogen of the benzoxazole group; and the blue sensitizers which are methine cyanines carrying benzoxazole, benzothiazole, benzoselenazole, naphthoxazole or naphthothiazole as the end groups which may be substituted in the 5 and/or 6 position by halogen, methyl, methoxy and have at least one sulphoalkyl substituent on the nitrogen.

* * * * *